US008273941B2

(12) United States Patent
Uematsu et al.

(10) Patent No.: US 8,273,941 B2
(45) **Date of Patent: *Sep. 25, 2012**

(54) NONWOVEN FABRIC, METHOD FOR PRODUCING NONWOVEN FABRIC, AND ABSORBENT ARTICLE

(75) Inventors: Katsuhiro Uematsu, Kagawa (JP); Hideyuki Ishikawa, Kagawa (JP); Kouichirou Tani, Kagawa (JP)

(73) Assignee: Uni-Charm Corporation, Ehime (JP)

( * ) Notice: Subject to any disclaimer, the term of this patent is extended or adjusted under 35 U.S.C. 154(b) by 272 days.

This patent is subject to a terminal disclaimer.

(21) Appl. No.: 12/532,785

(22) PCT Filed: Apr. 14, 2008

(86) PCT No.: PCT/JP2008/057238

§ 371 (c)(1),
(2), (4) Date: Jan. 8, 2010

(87) PCT Pub. No.: WO2008/133067

PCT Pub. Date: Nov. 6, 2008

(65) Prior Publication Data

US 2010/0137824 A1 Jun. 3, 2010

(30) Foreign Application Priority Data

Apr. 17, 2007 (JP) ..... 2007-108600
Apr. 17, 2007 (JP) ..... 2007-108601

(51) Int. Cl.
*A61F 13/15* (2006.01)
*D04H 1/50* (2006.01)

(52) U.S. Cl. . 604/378; 604/379; 604/380; 604/385.101; 264/342 R; 156/84; 156/85

(58) Field of Classification Search ..... 604/378, 604/379, 380, 385.101; 264/342 R; 156/84, 156/85

See application file for complete search history.

(56) References Cited

U.S. PATENT DOCUMENTS

| | | | | |
|---|---|---|---|---|
| 3,917,448 | A | 11/1975 | Wood | |
| 4,027,672 | A | 6/1977 | Karami | |
| 5,229,184 | A | 7/1993 | Campbell et al. | |
| 2001/0020157 | A1 * | 9/2001 | Mizutani et al. | 604/385.04 |

FOREIGN PATENT DOCUMENTS

| | | | |
|---|---|---|---|
| JP | 4-221556 | A | 8/1992 |
| JP | 04-272261 | A | 9/1992 |
| JP | 10-137167 | A | 5/1998 |
| JP | 2000-262558 | A | 9/2000 |
| JP | 2004-033236 | A | 2/2004 |

OTHER PUBLICATIONS

PCT/JP2008/057238 International Search Report.
European Search Report for EP 08740326, mailed Feb. 24, 2011.

* cited by examiner

*Primary Examiner* — Jacqueline F. Stephens
(74) *Attorney, Agent, or Firm* — Lowe, Hauptman, Ham & Berner LLP

(57) ABSTRACT

The invention provides a nonwoven fabric having good fluid drawing properties, in which fluid hardly remains, a method for producing a nonwoven fabric, and an absorbent article. The nonwoven fabric has a thickness direction and a planar direction perpendicular to the thickness direction, and includes a high density region having a higher fiber density than an average fiber density. The high density region penetrates from one side to another side in the thickness direction.

16 Claims, 18 Drawing Sheets

| SAMPLE | STRUCTURE | MATERIAL (SHEATH /CORE) | SHEATH/ CORE RATIO (RATIO BY WEIGHT) | FIBER DIAMETER (T) | FIBER LENGTH (mm) | WEB SHRINKAGE RATIO AT 145 °C(%) | MIXING RATIO (%) | WEIGHT (g/m2) | AVERAGE ABSORBANCE | INDEX OF DISPERSION (STANDARD DEVIATION) |
|---|---|---|---|---|---|---|---|---|---|---|
| EXAMPLE A | SC | PE/PET | 40/60 | 4.4 | 32 | 20 | 70 | 30 | 582 | 287 |
| | | PE/PET | 40/60 | 2.8 | 51 | 30 | 30 | | | |
| EXAMPLE B | SC | PE/PET | 40/60 | 4.4 | 32 | 20 | 100 | 30 | 919 | 396 |
| EXAMPLE C | SC | PE/PET | 40/60 | 4.4 | 32 | 20 | 70 | 30 | 964 | 326 |
| | | PE/PET | 40/60 | 2.8 | 51 | 1.0 | 30 | | | |
| EXAMPLE D | SC | PE/PET | 40/60 | 4.4 | 32 | 20 | 70 | 30 | 956 | 368 |
| | | PE/PET | 40/60 | 2.8 | 32 | 30 | 30 | | | |
| EXAMPLE E | SC | PE/PET | 40/60 | 6.0 | 51 | 20 | 50 | 30 | 580 | 320 |
| | | PE/PET | 40/60 | 2.8 | 51 | 30 | 50 | | | |
| COMPARATIVE EXAMPLE A | SC | PE/PET | 40/60 | 4.4 | 51 | 1.0 | 100 | 30 | 575 | 204 |
| COMPARATIVE EXAMPLE B | SC | PE/PET | 40/60 | 4.4 | 51 | 1.0 | 100 | 30 | 563 | 206 |

FIG. 14

| SAMPLE | STRUCTURE | MATERIAL (SHEATH /CORE) | SHEATH/ CORE RATIO (RATIO BY WEIGHT) | FIBER DIAMETER (T) | FIBER LENGTH (mm) | WEB SHRINKAGE RATIO AT 145 °C(%) | MIXING RATIO (%) | WEIGHT (g/m2) | AVERAGE ABSORBANCE | INDEX OF DISPERSION (STANDARD DEVIATION) |
|---|---|---|---|---|---|---|---|---|---|---|
| EXAMPLE D | SC | PE/PET | 40/60 | 4.4 | 32 | 20 | 70 | 30 | 956 | 368 |
| | | PE/PET | 40/60 | 2.8 | 32 | 30 | 30 | | | |
| EXAMPLE D2 | SC | PE/PET | 40/60 | 4.4 | 32 | 20 | 70 | 60 | 1885 | 391 |
| | | PE/PET | 40/60 | 2.8 | 32 | 30 | 30 | | | |
| EXAMPLE D3 | SC | PE/PET | 40/60 | 4.4 | 32 | 20 | 70 | 90 | 2699 | 401 |
| | | PE/PET | 40/60 | 2.8 | 32 | 30 | 30 | | | |

FIG. 15

| USED SAMPLE | | | EXAMPLE A | EXAMPLE E | COMPARATIVE EXAMPLE A | COMPARATIVE EXAMPLE B |
|---|---|---|---|---|---|---|
| C/S THICKNESS | (mm) | | 0.67 | 0.68 | 1.4 | 0.30 |
| DENSITY | (g/cm3) | | 0.045 | 0.044 | 0.021 | 0.100 |
| SPEED OF ABSORPTION | (S) | 80ml | 11 | 11 | 11 | 15 |
| | | 160ml | 12 | 13 | 13 | 20 |
| | | 240ml | 17 | 24 | 17 | 32 |
| FLUID DRAINAGE RATE | (S) | 80ml | 26 | 30 | 32 | 28 |
| | | 160ml | 105 | 154 | 170 | 130 |
| | | 240ml | 130 | 218 | × | 240 |

FIG. 16

| USED SAMPLE | SURFACE SHEET | | | SECOND SHEET | | | ARTIFICIAL MENSTRUAL BLOOD | | | |
|---|---|---|---|---|---|---|---|---|---|---|
| | | | | | | | FIRST TIME 95ml/min 3ml | SECOND TIME 95ml/min 3ml | RE-WET RATE | |
| | THICKNESS UNDER A LOAD OF 3 g/cm2 | WEIGHT | DENSITY | THICKNESS UNDER A LOAD OF 3 g/cm2 | WEIGHT | DENSITY | AFTER 1 MIN. | AFTER 1 MIN. | 51g/cm2 AFTER 1.5 MIN. | 106g/cm2 AFTER 1.5 MIN. |
| EXAMPLE D1 | 1.71 | 34 | 0.020 | 1.42 | 61 | 0.043 | PERMEATION TIME:3.9S COMPLETE DRYING TIME:7.0S SURFACE SCATTERING :18 × 36mm | PERMEATION TIME:5.2S COMPLETE DRYING TIME:9.0S SURFACE SCATTERING :19 × 46mm | 5.7% | 8.5% |
| EXAMPLE D2 | 1.71 | 34 | 0.020 | 1.45 | 62 | 0.043 | PERMEATION TIME:4.1S COMPLETE DRYING TIME:8.0S SURFACE SCATTERING :20 × 22mm | PERMEATION TIME:6.5S COMPLETE DRYING TIME:8.0S SURFACE SCATTERING :20 × 42mm | 5.4% | 7.9% |
| COMPARATIVE EXAMPLE A | 1.71 | 34 | 0.020 | 2.50 | 147 | 0.059 | PERMEATION TIME:5.1S COMPLETE DRYING TIME: × SURFACE SCATTERING :44 × 14mm | PERMEATION TIME:7.4S COMPLETE DRYING TIME: × SURFACE SCATTERING :47 × 17mm | 13% | 19% |
| COMPARATIVE EXAMPLE B | 1.71 | 34 | 0.020 | 1.50 | 17 | 0.011 | PERMEATION TIME:3.8S COMPLETE DRYING TIME: × SURFACE SCATTERING :32 × 14mm | PERMEATION TIME:5.8S COMPLETE DRYING TIME: × SURFACE SCATTERING :42 × 18mm | 10% | 15% |

* EXAMPLE D1: SAMPLE FORMED BY FOLDING NONWOVEN FABRIC WITH FREE FACE (FACE OPPOSITE TO NET) PLACED INSIDE
* EXAMPLE D2: SAMPLE FORMED BY FOLDING NONWOVEN FABRIC WITH FREE FACE (FACE OPPOSITE TO NET) PLACED OUTSIDE
* "×" FOR COMPLETE DRYING TIME INDICATES NONWOVEN FABRIC DID NOT DRY AFTER 1 MIN.

FIG. 17

| USED SAMPLE EXAMPLE D | AVERAGE EMPTY SPACE AREA BETWEEN FIBERS | | |
|---|---|---|---|
| | HIGH DENSITY REGION | LOW DENSITY REGION | |
| FREE FACE SIDE (THE OTHER SIDE) | 345 μm2 | 832 μm2 | |
| SUPPORTED FACE SIDE (ONE SIDE) | 532 μm2 | 1199 μm2 | DIFFERENCE |
| AVERAGE | 439 μm2 | 1016 μm2 | 577 μm2 |

FIG. 18

NONWOVEN FABRIC, METHOD FOR PRODUCING NONWOVEN FABRIC, AND ABSORBENT ARTICLE

RELATED APPLICATIONS

The present application is based on International Application PCT/JP2008/057238, filed Apr. 14, 2008, which claims priority from Japanese Application Number 2007-108600, filed Apr. 17, 2007, the disclosures of which are hereby incorporated by reference herein in their entirety.

TECHNICAL FIELD

The present invention relates to nonwoven fabrics, methods for producing nonwoven fabrics, and absorbent articles.

BACKGROUND ART

Conventionally, in order to improve the fluid drawing properties of nonwoven fabrics and suppress remaining fluid therein, various ideas have been devised relating to the types of fiber mixed into nonwoven fabrics or the structure of nonwoven fabrics.

For example, with respect to an absorbent article in which a nonwoven fabric is disposed as a second sheet between a fluid-permeable surface sheet and a fluid-retaining absorbent body, it is an issue that fluid on the surface sheet is easily drawn inside the second sheet (good fluid drawing properties), and that the drawn fluid moves to the absorbent body without remaining in the second sheet (suppressing remaining fluid).

Accordingly, an absorbent article has been proposed whose second sheet (fluid-permeable sheet) has a multi-layer structure in which a first layer positioned on a side close to the absorbent body contains high heat-shrinkable fiber (coiled fiber) and an average fiber density of the first layer is higher than an average fiber density of a second layer positioned on a side close to the surface sheet (for example, see JP-A-2004-33236).

DISCLOSURE OF INVENTION

Problems to be Solved by the Invention

However, in the second sheet disclosed in JP-A-2004-33236, when the coiled fiber is disposed unevenly, there is no difference in fiber density between the first layer and the second layer if the coiled fiber is not present in the first layer in the vicinity of a border between the first layer and the second layer, for example. As a result, there is a risk that fluid in the second layer cannot be drawn to the first layer. In such a case, fluid remains in the second layer (inside the second sheet).

An advantage of the invention is to provide a method for producing a nonwoven fabric having good fluid drawing properties, in which fluid hardly remains.

Means for Solving the Problems

In order to solve the above described problem, a primary aspect of the invention is a nonwoven fabric that has a thickness direction and a planar direction perpendicular to the thickness direction, the nonwoven fabric including a high density region having a higher fiber density than an average fiber density, wherein the high density region penetrates from one side to the other side in the thickness direction.

Features and advantages of the invention other than the above will become clear by reading the description of the present specification with reference to the accompanying drawings.

Effect of the Invention

The invention can provide a nonwoven fabric having good fluid drawing properties, in which fluid hardly remains, a method for producing the nonwoven fabric, and an absorbent article.

BRIEF DESCRIPTION OF DRAWINGS

FIG. 14 This is a table describing a structure of nonwoven fabrics of Examples and the measurement results of the average absorbance of the nonwoven fabrics.

FIG. 15 This is a table describing measurement results of the average absorbance in the case where the nonwoven fabrics of an Example D are layered.

FIG. 16 This is a table describing evaluation results of the absorption properties using artificial urine for the nonwoven fabrics of the Examples.

FIG. 17 This is a table describing evaluation results of the absorption properties using artificial menstrual blood for the nonwoven fabrics of the Examples.

FIG. 18 This is a table describing measurement results of the average empty space area between fibers in the Example D.

LIST OF REFERENCE NUMERALS

Figure 1:
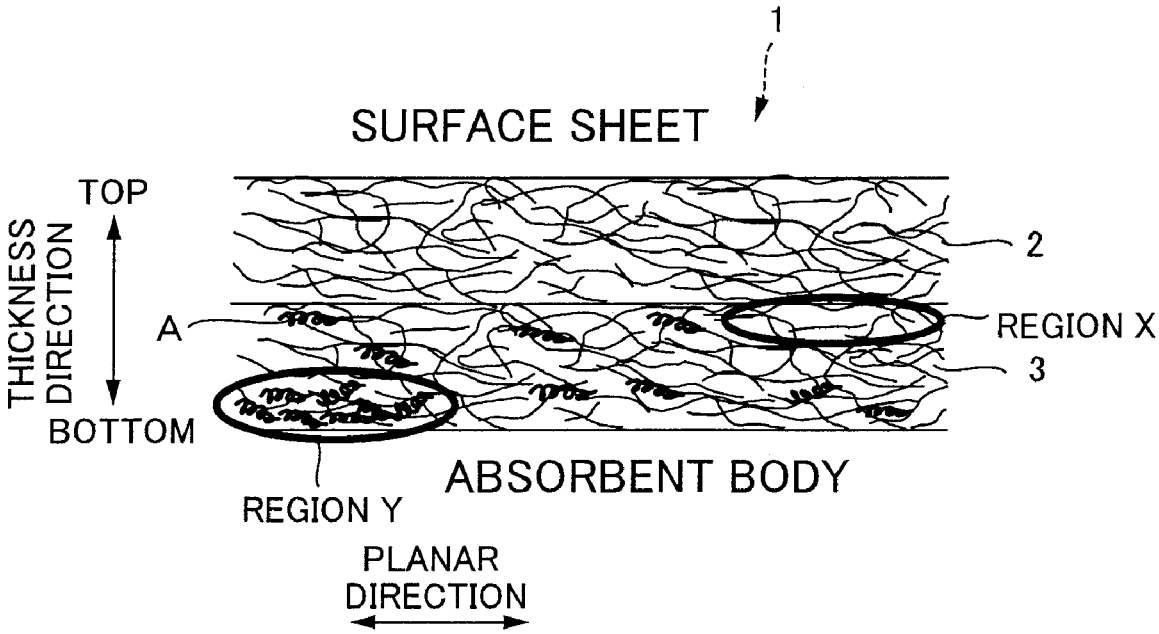
FIG. 1 This is a cross-sectional view of a nonwoven fabric of a comparative example.

1 nonwoven fabric of a comparative example, 2 upper layer, 3 lower layer, A coiled fiber, 10 nonwoven fabric (second sheet), 11 high density region, 12 low density region, 20 support member, 21 fibrous web, 22 heat-shrinkable fiber, 23 thermal welding fiber, 24 fiber cloth (fibrous web), 30 sanitary napkin (absorbent article), 31 surface sheet, 32 absorbent body, 33 back face sheety, 40 fluid, 50 carding machine, 51A first heat-shrinkable fiber, 51B second heat-shrinkable fiber, 52 conveyor, 53 conveyor, 54 heating device, 55 conveyor, 56 roll, 57A first transport roll, 57B second transport roll, 58 reel-in section, 59 roll, 60 heating device, 61 roll, 62 upper support member, 63 lower support member

BEST MODE FOR CARRYING OUT THE INVENTION

At least the following matters will be made clear by reading the description of the present specification with reference to the accompanying drawings.

A nonwoven fabric that has a thickness direction and a planar direction perpendicular to the thickness direction, the nonwoven fabric including: a high density region having a higher fiber density than an average fiber density, the high density region penetrating from one side to another side in the thickness direction.

With such a nonwoven fabric, by drawing a small amount of fluid on the nonwoven fabric to the high density region due to capillary force, it is possible to prevent the fluid from remaining on the nonwoven fabric. Also, it is possible to draw to the high density region a small amount of fluid remaining in a portion of the nonwoven fabric other than the high density region, due to the capillary force. Further, when the fluid is moved from the nonwoven fabric to the absorbent body having a higher density than the nonwoven fabric, for example, the fluid drawn to the high density region is moved to the absorbent body due to the capillary force, and therefore the fluid does not remain inside the nonwoven fabric.

Such a nonwoven fabric, wherein in the high density region, a fiber density in the other side is higher than a fiber density in the one side.

With such a nonwoven fabric, the fluid easily moves from the one side to the other side of the nonwoven fabric because the capillary force is higher in the other side than in the one side in the thickness direction of the nonwoven fabric.

Such a nonwoven fabric, wherein the nonwoven fabric includes a low density region that penetrates from the one side to the other side in the thickness direction of the nonwoven fabric and that has a lower fiber density than the average fiber density, and a plurality of the high density regions and a plurality of the low density regions are dispersed in the planar direction.

With such a nonwoven fabric, a large amount of fluid or high-viscosity fluid can permeate the nonwoven fabric through the low density region without interference by fibers, and therefore the fluid can be prevented from being scattered in the planar direction. Also, both "good fluid drawing properties" and "low remaining properties" due to the high density region, and "low scattering properties (good spot absorbing properties)" due to the low density region can be achieved.

Such a nonwoven fabric, wherein an index of dispersion that indicates a degree to which the high density region and the low density region in the nonwoven fabric disperse is from 250 to 450 inclusive.

With such a nonwoven fabric, the above-described properties of both the high density region and the low density region can be achieved.

A method for producing a nonwoven fabric, including: a step of heating in which a fibrous web that contains a heat-shrinkable fiber having thermal welding properties and has a thickness direction is heated, and in which the fibrous web is heated at a temperature at which the heat-shrinkable fiber can melt and undergo thermal shrinkage, such that the fibrous web that has been heated has irregularities on a surface of the fibrous web and fibers are more densely gathered in a region corresponding to a convex section than in a region corresponding to a concave section; and a step of pressing the fibrous web in the thickness direction such that the convex section of the irregularities that has been formed in the step of heating is crushed.

With such a nonwoven fabric production method, for example, it is possible to produce a nonwoven fabric that includes the high density region having a higher fiber density than the average fiber density of the nonwoven fabric and the low density region having a lower fiber density than the average fiber density, and in which the high density region and the low density region penetrate from one side to the other side in the thickness direction of the nonwoven fabric.

Such a nonwoven fabric production method, wherein in the step of heating, the fibrous web is heated with being supported by a support member on one side of the fibrous web in the thickness direction.

With such a nonwoven fabric production method, irregularities are formed on a face opposite to the supported side, and in contrast, irregularities are not formed on the supported side since the relocation of the heat-shrinkable fiber is restricted. That is, since the convex section formed only on one side of the fibrous web is pressed, in the high density region formed in the nonwoven fabric, the fiber density can be set higher in the opposite side to the supported side than in the supported side.

Such a nonwoven fabric production method, wherein in the step of pressing, the fibrous web is pressed with being heated at the temperature.

With such a nonwoven fabric production method, it is possible to easily crush the convex section.

Such a nonwoven fabric production method, wherein in the step of pressing, the fibrous web is pressed such that a thickness of the fibrous web is equal to or smaller than a thickness of the concave section.

With such a nonwoven fabric production method it is possible to produce a nonwoven fabric having an approximately uniform thickness.

Such a nonwoven fabric production method, wherein in the step of heating, heating is performed by hot air blowing at the temperature to the fibrous web from both sides thereof in the thickness direction.

With such a nonwoven fabric production method, irregularities are formed on both sides of the fibrous web. Therefore, in the high density region of the nonwoven fabric, a condition does not occur in which one of surfaces of the nonwoven fabric has a higher density than the other. Accordingly, it is possible to make the fiber density on both faces of the nonwoven fabric to be approximately equal.

An absorbent article that has a thickness direction and a planar direction perpendicular to the thickness direction and that is attached to human body, the absorbent article including: a surface sheet, at least part of which is fluid-permeable; a fluid-impermeable back face sheet; a fluid-retaining absorbent body disposed between the surface sheet and the back face sheet; and a second sheet disposed between the surface sheet and the absorbent body, the second sheet being a nonwoven fabric, the nonwoven fabric including a high density region that has a higher fiber density than an average fiber density of the nonwoven fabric, and the high density region penetrating from a side close to the surface sheet to a side close to the absorbent body of the nonwoven fabric in the thickness direction.

With such an absorbent article, a small amount of fluid on the surface sheet can be drawn into the second sheet. Therefore, the user does not feel discomfort (wet and sticky), and it is possible to prevent the skin of the user from being soiled. Also, since the fluid moves to the absorbent body without remaining in the second sheet, it is possible to prevent the fluid from overflowing on the surface sheet even if the fluid is excreted repeatedly.

Nonwoven Fabric

Nonwoven Fabric of Comparative Example

Firstly, a nonwoven fabric 1 of a comparative example, which is different from a nonwoven fabric produced by a method for producing a nonwoven fabric of the present embodiment, will be described. FIG. 1 is a diagram showing a cross-sectional view of the nonwoven fabric 1 of the comparative example. The nonwoven fabric 1 of the comparative example is configured of an upper layer (corresponding to a second layer) and a lower layer 3 (corresponding to a first layer). An average fiber density of the lower layer 3 is higher than that of the upper layer 2 so as to facilitate movement of fluid from the upper layer 2 to the lower layer 3.

The lower layer 3 of the nonwoven fabric 1 of the comparative example is formed by a fibrous web (in which fibers are not welded to each other, and the fibers are free from each other) that contains a high heat-shrinkable fiber having thermal welding properties. Also, the lower layer 3 is formed as a result of the fibrous web being heated in a state in which the fibrous web is not subject to any significant tensile force in a thickness direction and a planar direction, so that fibers are welded to each other therebetween. In the case of fiber such as a high heat-shrinkable fiber, which exhibits a high shrinkage ratio due to heating (for example, the shrinkage ratio with respect to the heating temperature is 70% or more), the high heat-shrinkable fiber is crimped as a result of heating in a coil form while tangling with surrounding fibers. On the other hand, the upper layer 2 of the nonwoven fabric 1 of the comparative example is formed by heating a fibrous web that does not contain a high heat-shrinkable fiber having thermal welding properties (or contains a smaller amount thereof than the lower layer 3). For this reason, the average fiber density of the lower layer 3 that contains fiber (coiled fiber A) obtained as a result of the high heat-shrinkable fiber being crimped in a coil form while tangling with surrounding fibers is higher than the average fiber density of the upper layer 2.

However, in the lower layer 3 of the nonwoven fabric 1 of the comparative example, the coiled fiber A is not always present uniformly, and there is a risk that the coiled fiber A may be present in a non-uniform manner. In particular, since the lower layer 3 is produced in a state in which significant tensile force is not applied thereto, the lower layer 3 is thick in the thickness direction (i.e., the lower layer 3 is bulky). Therefore, as shown in FIG. 1 for example, there is a possibility that the coiled fiber A is not present in a region X, which is on an upper face side of the lower layer 3 that contacts the upper layer 2. In such a case, a difference in the fiber density is not created between the upper layer 2 and the region X (the lower layer 3). As a result thereof, fluid in the upper layer 2 cannot be drawn to the region X in the lower layer 3 due to capillary force.

Conversely, when a large number of the coiled fibers A gathers as shown in a region Y in FIG. 1, the fiber density in the region Y will be increased too much. Thus, a large amount of fluid or fluid having a high viscosity cannot permeate through the fibers, which results in the fluid remaining in the nonwoven fabric 1, or the fluid scattering in the planar direction.

For this reason, for example, even if the nonwoven fabric 1 of the comparative example is disposed as the second sheet of the absorbent article between a fluid-permeable surface sheet and a fluid-retaining absorbent body such that the upper layer 2 is positioned on the surface sheet side, there is a risk that the fluid may remain in the surface sheet or the second sheet. In such a case, a user will feel discomfort (a wet and sticky sensation) and the skin of the wearer will be soiled.

Accordingly, an advantage of the present embodiment is to provide a method for producing a nonwoven fabric having good fluid drawing properties, in which fluid hardly remains. A nonwoven fabric 10 produced by the nonwoven fabric production method of the present embodiment will be described below.

Figure 2A:
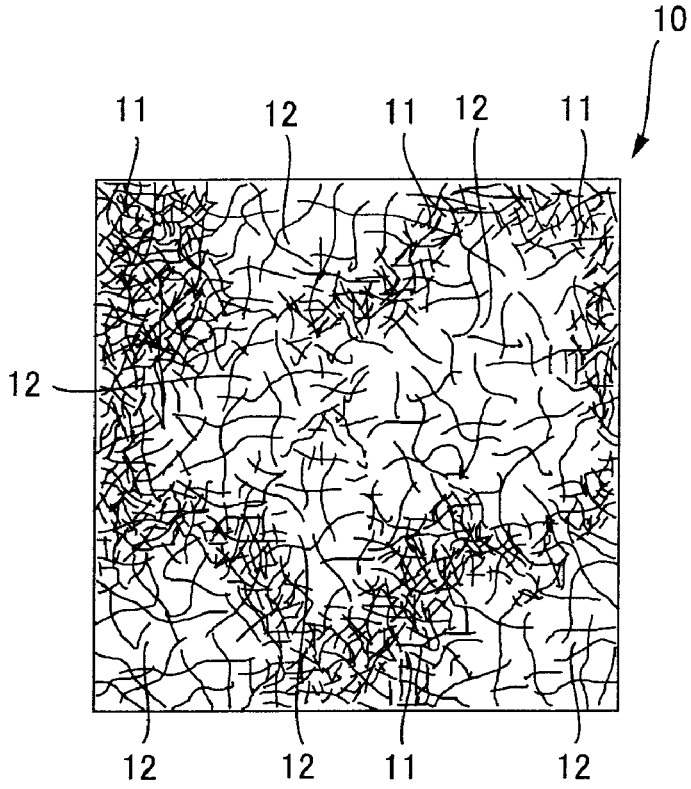
FIG. 2A is a top view of a nonwoven fabric of the present embodiment.
Figure 2B:
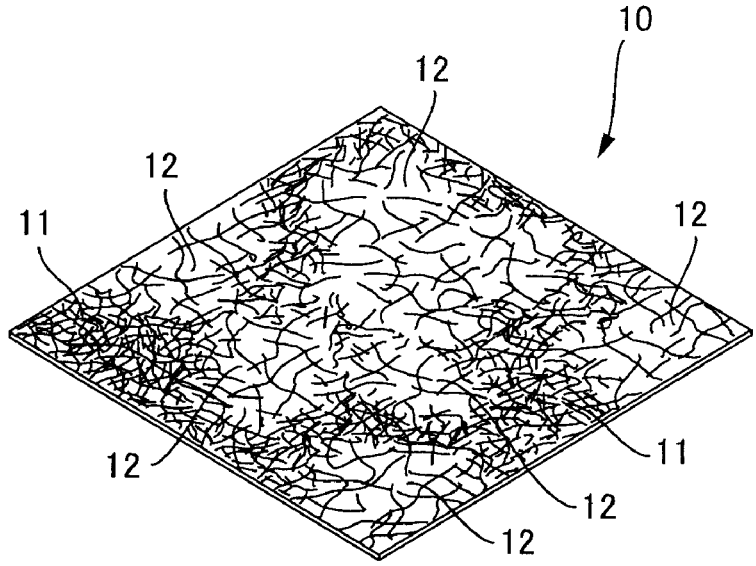
FIG. 2B is a perspective view of the nonwoven fabric of the present embodiment.
Figure 3A:
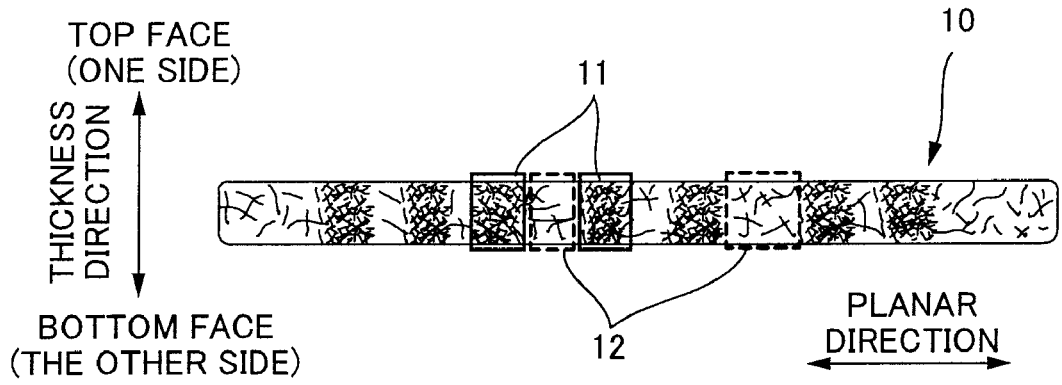
FIG. 3A is a cross-sectional view of the nonwoven fabric of the present embodiment.
Figure 3B:
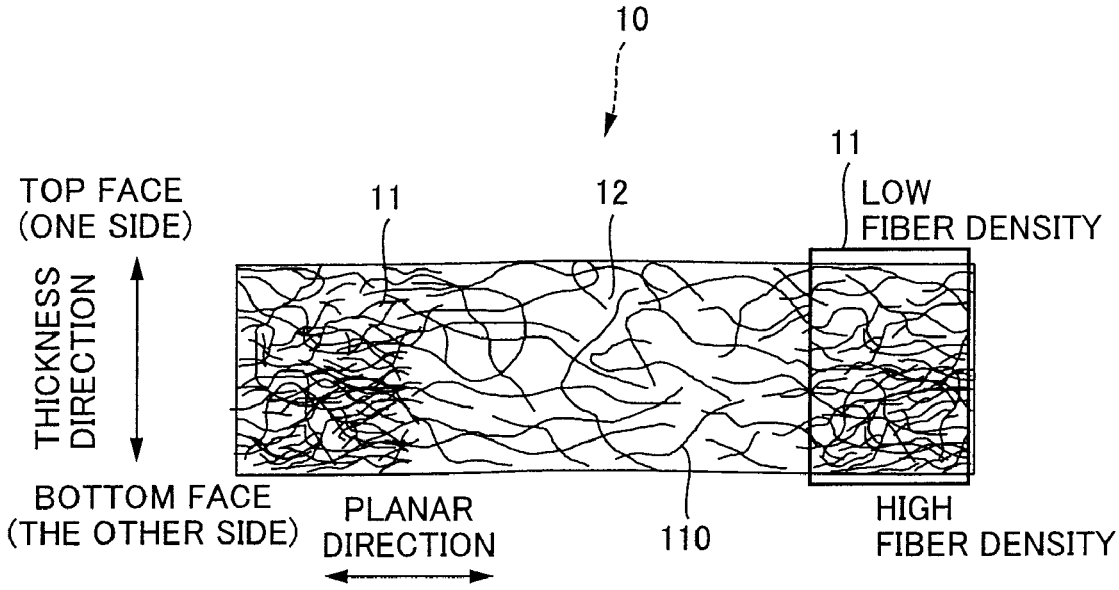
FIG. 3B is an enlarged view of the cross section.

Outline of Nonwoven Fabric 10 Produced by Nonwoven Fabric Production Method of Present Embodiment FIG. 2A is a top view of the nonwoven fabric 10 of the present embodiment, and FIG. 2B is a perspective view of the nonwoven fabric 10 of the present embodiment. FIG. 3A is a cross-sectional view of the nonwoven fabric 10 of the present embodiment, and FIG. 3B is an enlarged view of the cross section.

The nonwoven fabric 10 of the present embodiment includes a high density region 11 having a higher fiber density than an average fiber density of the entire nonwoven fabric 10, and a low density region 12 having a lower fiber density than the average fiber density. The high density region 11 and the low density region 12 are, as shown in FIG. 2A, formed dispersed in a planar direction of the nonwoven fabric 10.

Also, as shown in FIG. 3A, the nonwoven fabric 10 of the present embodiment has a substantially uniform thickness, and the high density region 11 penetrates from one side (top face) in a thickness direction of the nonwoven fabric 10 to the other side thereof (bottom face). Similarly, the low density region 12 also penetrates from the one side to the other side of the nonwoven fabric 10. Furthermore, in the high density region 11, the fiber density is higher in the other side than in the one side, as shown in FIG. 3B.

Figure 4:
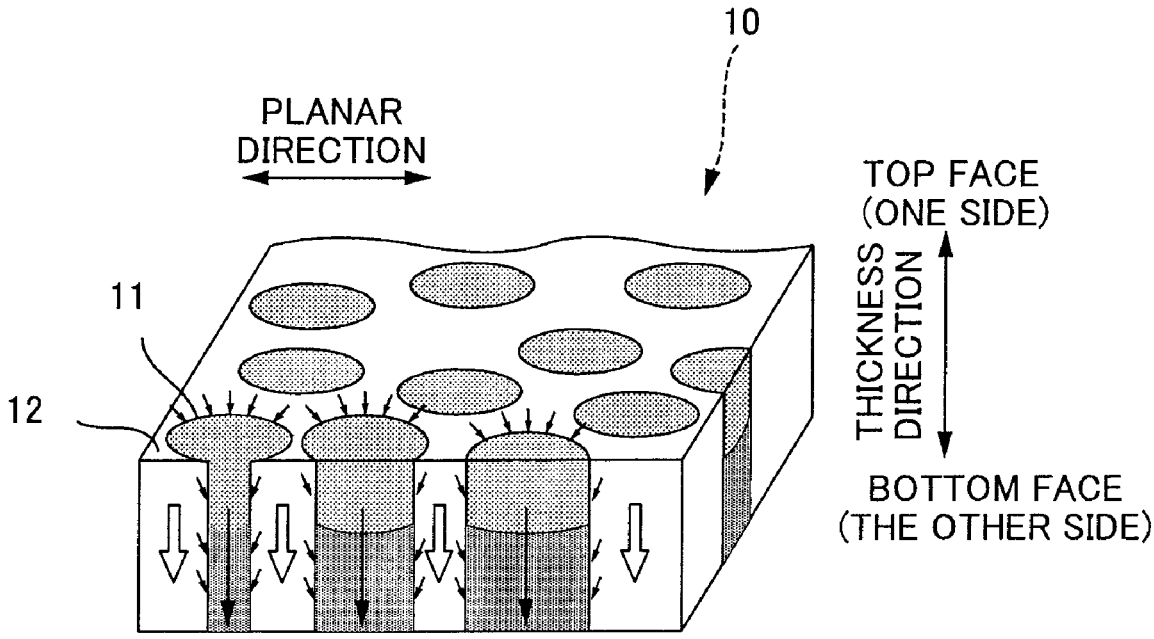
FIG. 4 This is a diagram showing how fluid permeates the nonwoven fabric of the present embodiment.

FIG. 4 is a diagram showing how fluid permeates the nonwoven fabric 10 of the present embodiment. Note that an absorbent body (not shown) is disposed that has a higher density in the bottom face of the nonwoven fabric 10 than the density in the high density region 11. How fluid that has been dripped onto the top face of the nonwoven fabric 10 permeates the nonwoven fabric 10 and moves to the absorbent body will be described below.

When a large amount of fluid is dripped onto the nonwoven fabric 10, the fluid passes through the low density region 12 where few fibers are present and thus the resistance against permeation is low, to move to the absorbent body. Even if a large amount of fluid is dripped, a large part of the fluid can move to the absorbent body quickly because the low density region 12 penetrates in the thickness direction. As a result, the fluid can be prevented from scattering in the top face (planar direction) of the nonwoven fabric 10.

Then, after a large part of the fluid has moved, a small amount of fluid remaining on the top face of the nonwoven fabric 10 can be drawn inside the nonwoven fabric 10 (inside the high density region 11) due to the capillary force of the high density region 11. Since the fiber density is higher in the bottom face than in the top face in the high density region 11, the fluid drawn to the high density region can be reliably moved to the absorbent body due to the capillary force.

In addition, it is possible that after a large part of the fluid has permeated the nonwoven fabric 10, the fluid remaining in the low density region 12 is drawn inside the high density region 11 due to the capillary force, and that consequently the fluid is moved to the absorbent body. Also, even when only a small amount of fluid is dripped onto the nonwoven fabric 10, it is possible to draw the fluid inside the high density region 11 and move the fluid to the absorbent body, due to the capillary force of the high density region 11.

In addition, while fluid having a high viscosity cannot permeate through the high density region 11 due to the resistance of a large number of fibers, such fluid having a high viscosity can move to the absorbent body through the low density region 12, without interference by the fibers.

That is, in the nonwoven fabric 10 of the present embodiment, the high density region 11 and the low density region 12, which penetrate from the top face to the bottom face of the nonwoven fabric 10, are dispersed in the planar direction of the nonwoven fabric 10. Therefore, fluid can permeate the nonwoven fabric 10 without being scattered regardless of the amount or viscosity of the fluid. Besides, it is also possible to prevent the fluid from remaining in the top face of or inside the nonwoven fabric 10. That is, the nonwoven fabric 10 of the present embodiment is a nonwoven fabric having low scattering properties, low remaining properties, and good fluid drawing properties.

It is not required for all of the high density regions having a high fiber density than the average fiber density of the nonwoven fabric 10 and the low density regions having a lower fiber density than the average fiber density to penetrate from one side to the other side of the nonwoven fabric. The above effects can be achieved when at least one high density region 11 and one low density region 12 penetrate from one side to the other side of the nonwoven fabric.

Not only in the high density region 11 but in the low density region 12 as well, the fiber density may be higher in the other side than in one side. In such a case, using the capillary force of the low density region, fluid can permeate the nonwoven fabric 10.

Here, specific fiber density will be described. However, since it is difficult to measure the fiber density, an "average empty space area between fibers" is used (details will be described later), as an alternative value for the fiber density.

An average empty space area of the high density region 11 is set to 300 $\mu m^2$ or more and 1000 $\mu m^2$ or less, and preferably, 400 $\mu m^2$ or more and 800 $\mu m^2$ or less. When there is a difference in fiber density between the top face and the bottom face in the high density region, a difference in average empty space area between the top face side and the bottom face side is set to 50 $\mu m^2$ or more and 200 $\mu m^2$ or less, and preferably, 60 $\mu m^2$ or more and 100 $\mu m^2$ or less.

An average empty space area in the low density region is set to 600 $\mu m^2$ or more and 8000 $\mu m^2$ or less, and preferably, 800 $\mu m^2$ or more and 1000 $\mu m^2$ or less. When there is a difference in fiber density between the top face and the bottom face in the low density region, a difference in average empty space area between the top face side and the bottom face side is set to 50 $\mu m^2$ or more and 200 $\mu m^2$ or less, and preferably, 60 $\mu m^2$ or more and 100 $\mu m^2$ or less.

A difference in average empty space area between the low density region 12 and the high density region 11 is set to 150 $\mu m^2$ or more $\mu m^2$ or more and 1000 $\mu m^2$ or less.

In addition, an "inter-fiber distance" can be used as an alternate value for the fiber density. An inter-fiber distance in the high density region 11 is set to, for example, 15 μm or more and 95 μm or less, and an inter-fiber distance in the low density region 12 is set to, for example, 85 μm or more and 390 μm or less.

Production Method and Constituent Fibers

The above-described nonwoven fabric 10 can be obtained by the following method. A fibrous web, in which the heat-shrinkable fiber having thermal welding properties is provided, is heated at a temperature at which the heat-shrinkable fiber can melt and undergoes thermal shrinkage such that a surface of the fibrous web after heating has irregularities and that fibers more densely gather in a region corresponding to a convex section than in a region corresponding to a concave section. Thereafter the fibrous web is pressed in the thickness direction such that the convex section in the irregularities formed by heating is crushed.

Note that the fibrous web is not limited to be formed with one type of heat-shrinkable fiber, and may be formed by mixing a plurality of types of heat-shrinkable fiber having thermal welding properties. Examples of the heat-shrinkable fiber used herein include eccentric sheath-core bicomponent fiber made up of two types of thermoplastic polymers having different shrinkage ratios, or side-by-side type bicomponent fiber. Examples of the thermoplastic polymers having different shrinkage ratios include a combination of ethylene/propylene random copolymer and polypropylene, a combination of polyethylene and ethylene/propylene random copolymer, and a combination of polyethylene and polyethylene terephthalate. Of these examples, the eccentric sheath-core bicomponent fiber is preferable, whose shrinkage ratio does not increase excessively at the heating temperature (145° C., for example) and that is easy to control. Note that the shrinkage ratio can be controlled by adjusting the distance by which a position of a core of eccentric sheath-core bicomponent fiber is shifted from the center thereof (decentering).

The nonwoven fabric production method in which the fibrous web is heated with being supported by the support member on the bottom side of the fibrous web in the thickness direction will be described below. FIGS. 5A to 5D are diagrams showing the nonwoven fabric production method of the present embodiment. Firstly, a row material made by blending heat-shrinkable fiber 22 having thermal welding properties and thermal welding fiber 23 is spread with a carding machine (not shown), so that a fibrous web 21 of a predetermined thickness is continuously formed. Also, in the formed fibrous web, the heat-shrinkable fiber 22 and the thermal welding fiber 23 are not necessarily uniformly present; a region where the heat-shrinkable fiber 22 is gathered and a region where the heat-shrinkable fiber 22 is not gathered are formed. Note that the fibrous web may be formed of a plurality of types of heat-shrinkable fiber. Also, the fibrous web may be formed by an air-laid method, instead of the carding method.

Figure 5A:
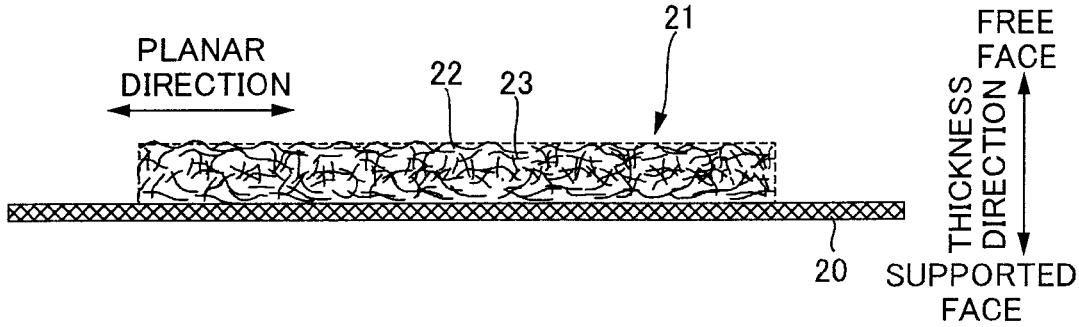
FIGS. 5A to 5D are diagrams illustrating an outline of a method for producing the nonwoven fabric of the present embodiment.

Then, as shown in FIG. 5A, the fibrous web 21 is heated at a predetermined temperature with being placed on a breathable net 20 (a plate-shaped support member having a planar surface, which has a mesh structure). That is, the fibrous web 21 is heated with being supported on the bottom side thereof.

Note that as a specific example, there is a method (to be described) in which the fibrous web 21 is heated by hot air blowing to the fibrous web 21 at a predetermined temperature from the top face side of the fibrous web 21, while being transported by a conveyor. The predetermined temperature refers to a temperature at which the heat-shrinkable fiber 22 melts and undergoes thermal shrinkage. For example, the temperature of the hot air blowing onto the fibrous web 21 is set to the range from 138° C. to 152° C. inclusive, preferably, from 142° C. to 150° C. inclusive. The wind speed of the hot air blowing from the top face side is preferably, approximately 0.7 m/s.

Figure 5B:
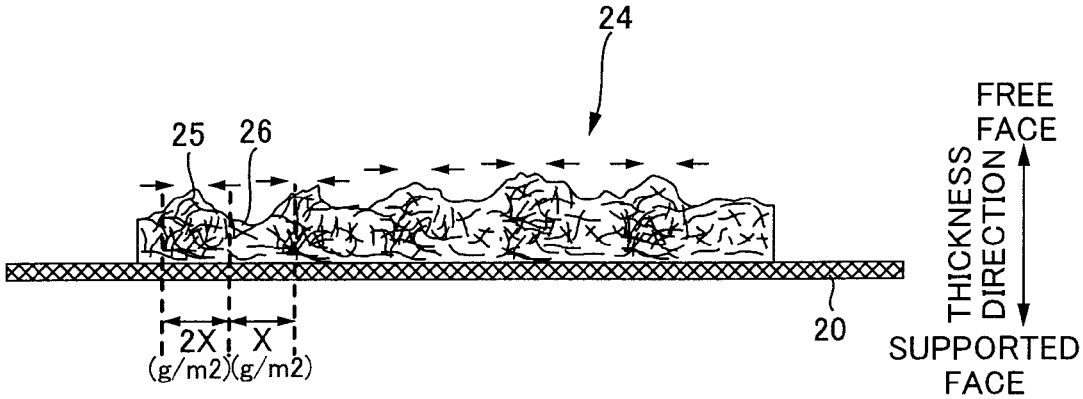

As a result, as shown in FIG. 5B, fibers in the fibrous web 21 melt and weld to other fibers, and a fiber cloth 24 (here, in order to distinguish from the fibrous web prior to heating, the fibrous web after subjected to heating is referred to as the "fiber cloth 24") is formed, in which fibers are heat-welding to each other. Also on a face (free face) of the fiber cloth 24 on a side opposite to a side supported by the breathable net 20, an irregular structure (sea-island structure) is formed. On the other hand, a face (supported face) of the fiber cloth 24 on a supported side is substantially flat along the surface of the breathable net 20.

During heating, the heat-shrinkable fiber 22 of the fibrous web 21 on the free face side is not prevented from shrinking action. Therefore, the heat-shrinkable fiber 22 shrinks freely in the planar direction while tangling with surrounding fibers (such as the thermal welding fiber 23). Specifically, a convex section 25 in the irregular structure is a region where heat-shrinkable fibers are gathered, and includes a large number of fibers that have been tangled with the heat-shrinkable fiber 22 during thermal shrinkage of the heat-shrinkable fiber 22. Therefore, the weight (corresponding to the fiber volume) of a region corresponding to the convex section 25 is higher than the average weight of the fiber cloth 24. In contrast, a concave section 26 is a region in which little heat-shrinkable fiber 22 is originally present and where the thermal welding fiber 23 has been tangled with the surrounding heat-shrinkable fiber 22 and relocated outside. Therefore, the weight of a region corresponding to the concave section 26 is lower than the stated average weight. In other words, fibers are more densely gathered in the region corresponding to the convex section than in the region corresponding to the concave section. In addition, since fibers present in the concave section 26 are relocated to the convex section 25 by heating, the convex section 25 and the concave section 26 are formed adjacent to each other.

Figure 5C:
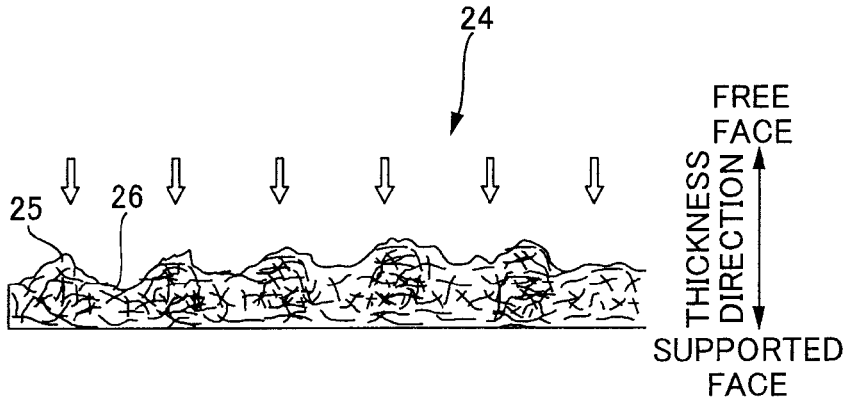
Figure 5D:
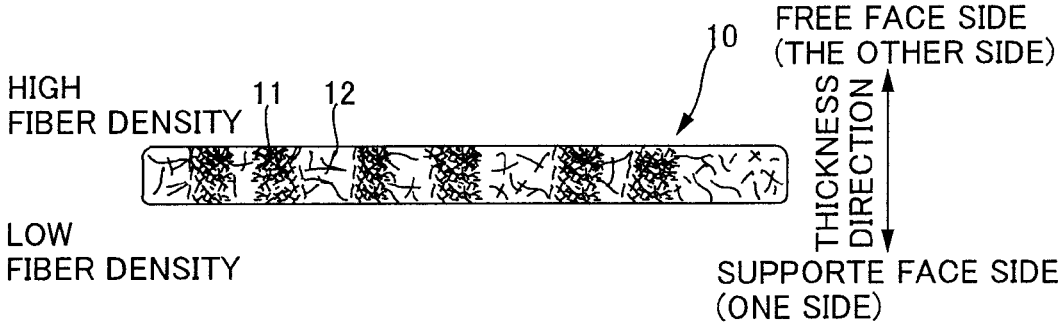

Thereafter, as shown in FIG. 5C, the fiber cloth 24 is pressed on its free face side on which the irregular structure is formed, such that the convex section 25 is crushed in a thickness direction of the fiber cloth 24. At this time, by pressing the fiber cloth 24 with a definite strength to a thickness smaller than the thickness of the concave section 26, it is possible to obtain the nonwoven fabric 10 having a substantially uniform thickness, as shown in FIG. 5D. In addition, if the fiber cloth 24 is pressed with being heated at a predetermined temperature, the convex section is easily crushed, and thus the free face side, which has been irregular, can be made more flat. A region where the convex section 25 is crushed becomes the high density region 11, while a region that was the concave section 26 becomes the low density region 12. Furthermore, since the convex section 25 and the concave section 26 are formed adjacent to each other, the high density region 11 and the low density region 12 are also present adjacent to each other in the planar direction.

Also, since the high density region 11 is formed by pressing the convex section 25 on the free face side of the fiber cloth 24, the fiber density is higher in the free face side than in the supported face side. Specifically, the free face in FIG. 5D corresponds to the bottom face of the nonwoven fabric 10 shown in FIG. 3B stated above, and the supported face in FIG. 5D corresponds to the top face of the nonwoven fabric 10 shown in FIG. 3B stated above.

By producing the nonwoven fabric as described above, it is possible to obtain the nonwoven fabric including the high density region where the fiber density is higher than the average fiber density of the entire nonwoven fabric 10, and the low density region where the fiber density is lower than the average fiber density, the high density region and the low density region penetrating from one side to the other side of the nonwoven fabric 10 in the thickness direction. In other words, with the production method described above, it is possible to obtain the nonwoven fabric having good fluid drawing properties, in which fluid hardly remains.

By heating the fibrous web with being supported on the bottom side thereof, the irregularities are formed on only one side (free face side) of the fibrous web. Therefore, it is possible to produce the nonwoven fabric 10 such that in the high density region 11 the fiber density is higher in the free face side than in the supported face side.

Also, in order to produce in a favorable manner the nonwoven fabric in which the high density region 11 and the low density region 12 are dispersed in the planar direction, and which the high density region 11 penetrates in the thickness direction of the nonwoven fabric, it is preferable to set the weight of the convex section 25 (2X g/m$^2$) when the fibrous web 21 is heated (FIG. 5B) to twice or more the weight of the concave section 26 (X g/m$^2$). For this purpose, it is possible to form a desired irregular structure of fiber by controlling "fiber properties" and "production conditions".

As specific examples of the fiber properties, when a predetermined temperature for heating is assumed to be 145° C., the thermal shrinkage ratio of the heat-shrinkable fiber used at 145° C. is set to 10% or more and 60% or less, and preferably, 15% or more and 40% or less.

An example of measurement method of the thermal shrinkage ratio is as follows: (1) manufacture a fibrous web of 200 g/m$^2$ using only the fiber to be measured, by a carding machine; (2) cut the fibrous web into a size of 250×250 mm; (3) wrap the cut web with craft paper (so as to avoid direct application of hot air, and to facilitate thermal shrinkage by making it easier for the fiber to slide); (4) leave what is obtained in (3) five minutes in the oven heated to 145° C.; (5) measure the length after thermal shrinkage; and (6) the thermal shrinkage ratio can be obtained through calculation based on the difference in lengths of fiber before and after the thermal shrinkage.

The shorter the fiber length of the heat-shrinkable fiber 22 is, more easily the heat-shrinkable fiber 22 relocates. However, if the heat-shrinkable fiber 22 is relocated excessively, the difference in the density between the high density region 11 and the low density region 12 becomes too large. Therefore, the fiber length is set to 25 mm or more and 70 mm or less, and preferably, 25 mm or more and 40 mm or less. For this reason, it is preferable to form the fibrous web by the carding method, which uses comparatively long fibers. The fiber thickness of the heat-shrinkable fiber 22 is preferably 1 Dtex or more and 11 Dtex or less, approximately.

Also the volume of heat-shrinkable fiber in the nonwoven fabric 10 is set to 30 wt % or more and 100 wt % or less, and preferably, 70 wt % or more and 100 wt % or less. When the heat-shrinkable fiber 22 is mixed in the above ratio, it is possible to form the high density region 11 and the low density region 12 in a manner dispersed in the planar direction of the nonwoven fabric 10.

Production conditions can be controlled as follows: for example, increasing the hot air pressure (wind speed) during heating makes relocation of fibers more difficult since the fibrous web 21 is pressed against the breathable net 20, whereas decreasing the hot air pressure (wind speed) makes relocation of fibers easier. In addition, it is also possible to vary the thermal shrinkage ratio by changing temperature. Therefore, the wind speed or temperature can be adjusted depending on the relocation state of fibers.

Figure 6:
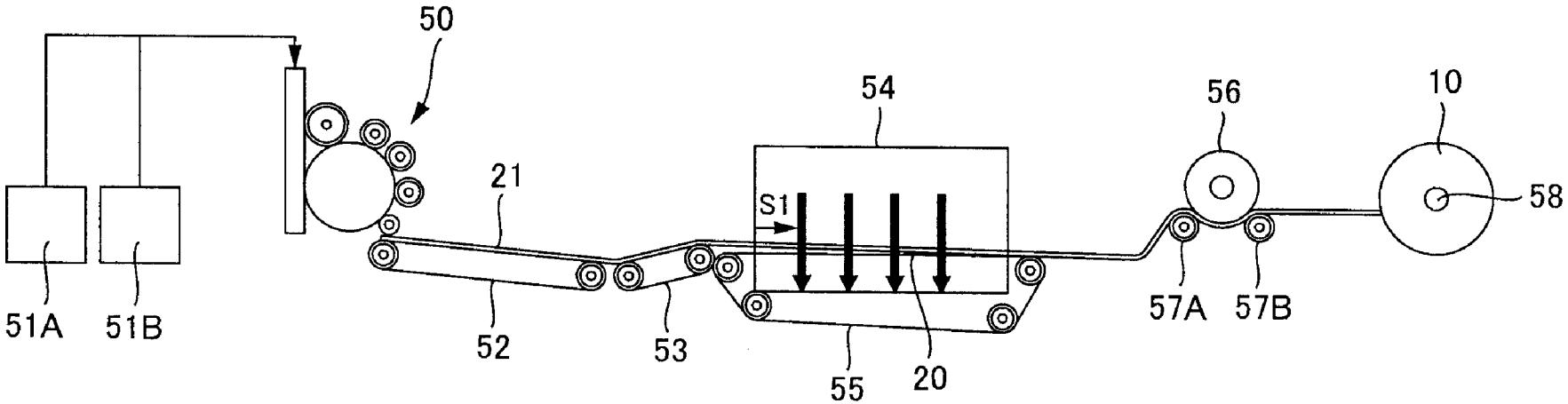
FIG. 6 This is a diagram showing an example of a nonwoven fabric production apparatus of the present embodiment.

A method for producing the nonwoven fabric 10 from the fibrous web 21 in which two types of heat-shrinkable fibers are blended will be described in detail below. FIG. 6 is a diagram showing an example of a nonwoven fabric production apparatus. Firstly, the nonwoven fabric production apparatus continuously forms the fibrous web 21 of a predetermined thickness by spreading in a spreading process a row material in which a first heat-shrinkable fiber 51A and a second heat-shrinkable fiber 51B are blended, using a carding machine 50. It is also possible to form the fibrous web 21 with only one of the first heat-shrinkable fiber 51A and the second heat-shrinkable fiber 51B.

Then, the fibrous web 21 is transported to an entrance of a heating device 54 by conveyors 52 and 53 in a first transport process. The fibrous web 21 in this first transport process is in a state in which fibers therein are free from each other.

Next, the fibrous web 21 is heated inside the heating device 54 while being transported at a speed S1 by a conveyor 55. Specifically, hot air at a predetermined temperature blows onto the fibrous web 21 from the top face side thereof while being transported by the conveyor 55. The predetermined temperature is a temperature at which the first heat-shrinkable fiber 51A and the second heat-shrinkable fiber 51B melt and undergo thermal shrinkage. With this hot air, the fibrous web 21 is heated with being pressed against the support member 20. For this reason, thermal shrinkage of the heat-shrinkable fiber of the fibrous web 21 on a side in contact with the support member 20 is restricted due to friction or the like.

In this manner, the support member 20 side of the fibrous web 21 is made flat, and the free face side, which is on the opposite side to the support member 20, is made irregular. Note that fibers are welded to each other in the fibrous web 21 (fiber cloth 24) after heating.

Thereafter, the fibrous web 21 is pressed such that the convex section is crushed by a roll 56. The roll 56 is disposed so as to contact the free face of the fibrous web 21 located between a first transport roll 57A and a second transport roll 57B. The fibrous web 21 is pressed at a definite strength by the roll 56, to be formed into the nonwoven fabric 10 of a substantially uniform thickness. Here, the roll 56 has been preferably heated to a predetermined temperature. The roll 56 heated to the predetermined temperature contacts the free face of the fibrous web 21 so that the convex section is crushed in the thickness direction in a favorable manner. The nonwoven fabric 10 formed in this manner is finally taken up by a reel-in section 58.

Figure 7:
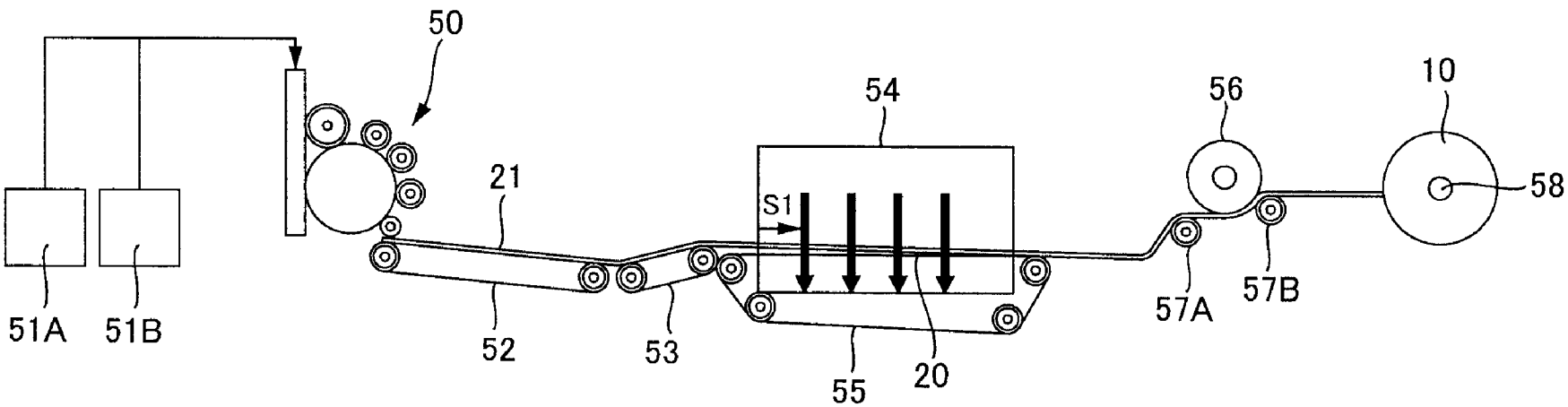
FIG. 7 This is a diagram showing a pressing method different from the method shown in FIG. 6.

Next, a pressing method different from that shown in FIG. 6 will be described. In FIG. 7, the transport rolls 57A and 57B are disposed in different positions compared with FIG. 6. In FIG. 6, the fibrous web 21 between the first transport roll 57A and the second transport roll 57B contacts the roll 56. On the other hand, the first transport roll 57A in FIG. 7 is not disposed so as to sandwich the fibrous web 21 with the first transport roll 57A and the roll 56. Therefore, the fibrous web 21 in FIG. 7 contacts the roll 56 by a shorter distance compared with the fibrous web 21 in FIG. 6. As a result, the nonwoven fabric 10 in FIG. 7 is pressed with a smaller force compared with the nonwoven fabric 10 in FIG. 6. That is, the pressing force applied to the fibrous web 21 can be adjusted by adjusting the disposition of the transport rolls 57A and 57B.

Figure 8:
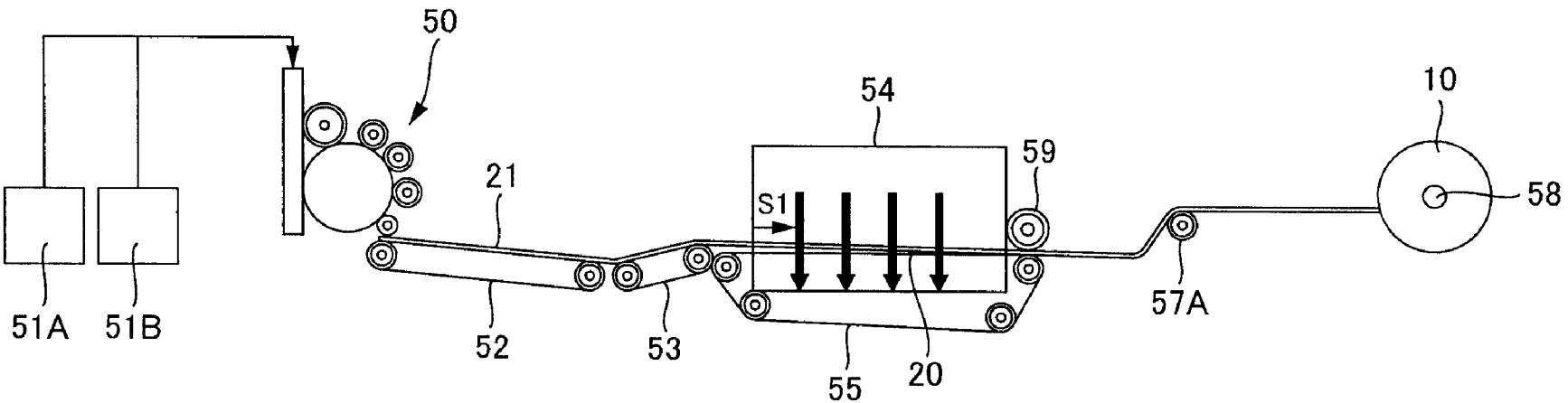
FIG. 8 This is a diagram showing a pressing method different from the method shown in FIG. 6.
Figure 9:
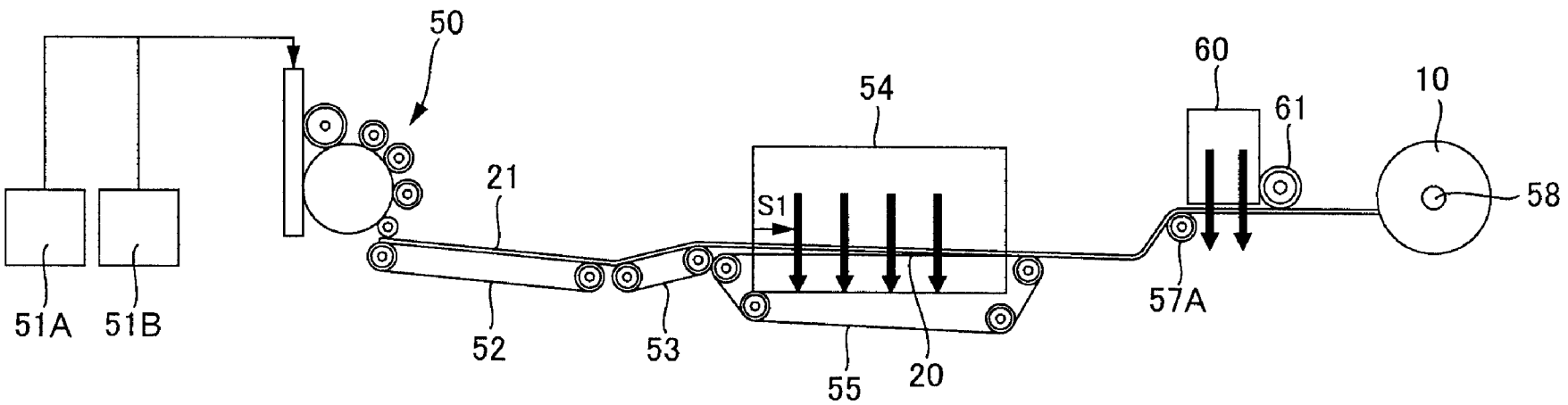
FIG. 9 This is a diagram showing a pressing method different from the method shown in FIG. 6.

In FIG. 8, a roll 59 is disposed in the vicinity of an exit of the heating device 54, so that the roll 59 contacts the free face of the fibrous web 21, which is maintained at the predetermined temperature immediately after heating. In this manner, the convex section can be crushed in a favorable manner. Also, as shown in FIG. 9, before pressing the fibrous web 21 with a roll 61, the fibrous web 21 may be heated again by a heating device 60.

Figure 10:
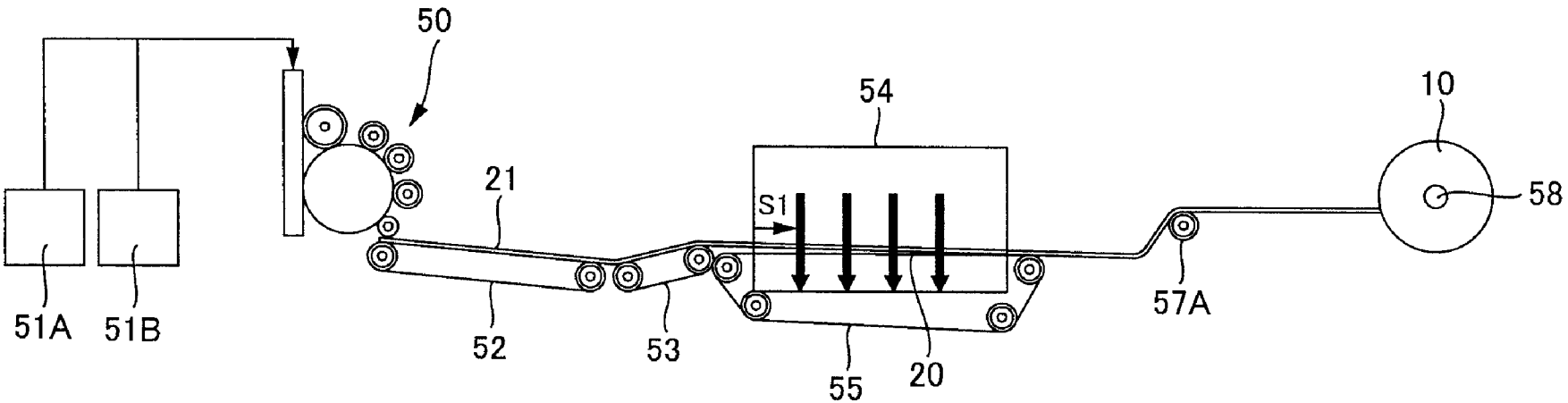
FIG. 10 This is a diagram showing a pressing method different from the method shown in FIG. 6.

Alternatively, as shown in FIG. 10, the convex section formed on the free face of the fibrous web 21 can be crushed in the thickness direction by taking up the nonwoven fabric 10 (fibrous web 21) by the reel-in section 58 so as to layer the nonwoven fabric 10 in a radial direction, without pressing the fibrous web 21 by the roll or the like. Particularly, since the supported face side of the fibrous web 21 having a flat surface and the free face side of the fibrous web 21 having an irregular surface are taken up so as to face each other, it is possible to evenly press the free face side of the fibrous web 21.

Figure 11:
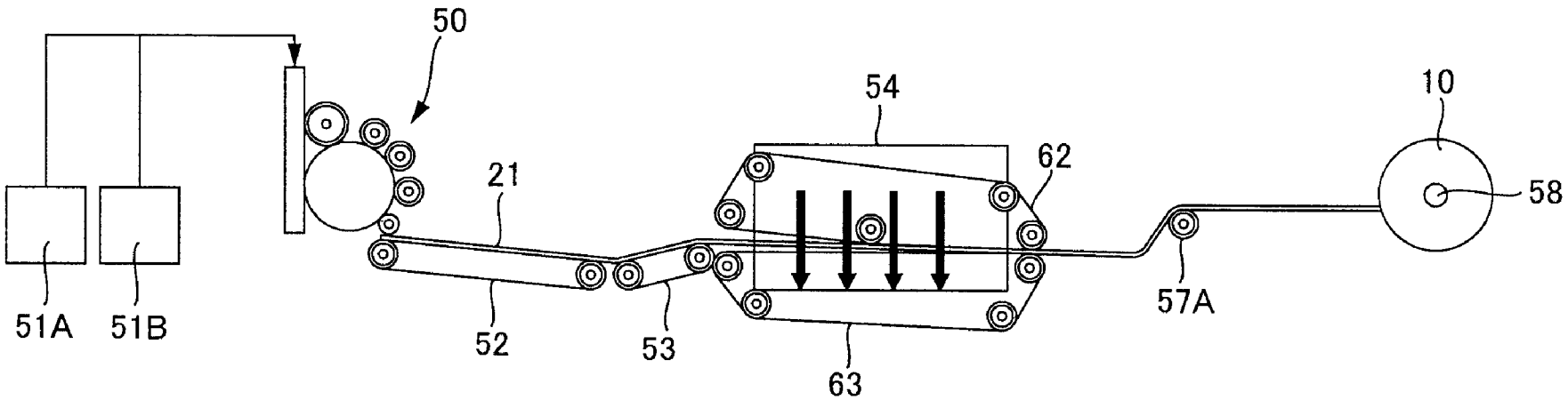
FIG. 11 This is a diagram showing a pressing method different from the method shown in FIG. 6.

Furthermore, in FIG. 11, in the first half portion of the heating device 54, a breathable upper support member 62 is disposed at a predetermined angle to the horizontal direction, so that the fibrous web 21 and the upper support member 62 do not contact each other. On the other hand, in the second half portion of the heating device 54, an upper support member 62 is disposed parallel to the horizontal direction, so that the top face of the fibrous web 21 and the upper support member 62 contact to each other. A lower support member 63 is disposed parallel to the horizontal direction, and supports the fibrous web 21 at the bottom face side thereof from the entrance to the exit of the heating device 54.

The fibrous web 21 carried into such a heating device 54 is blown with hot air that has passed through the upper support member 62, in the first half portion of the heating device 54, with the fibrous web 21 being supported at the bottom face side. As a result, the irregularities are formed on the top face side of the fibrous web 21. Thereafter, in the second half portion of the heating device 54, the fibrous web 21 is transported while being sandwiched between the lower support member 63 and the upper support member 62, and the convex section formed on the top face side of the fibrous web 21 is pressed so as to crush the convex section.

Modified Examples of Nonwoven Fabric Production Method

Differing from the above-described nonwoven fabric production method, in the present modified example, the fibrous web 21 is heated such that hot air at a predetermined temperature blows from both sides of the fibrous web 21 in the thickness direction. For example, in heating device (not shown), breathable support members are disposed on the top and bottom sides of the fibrous web 21, respectively. Hot air at a predetermined temperature blows onto the fibrous web 21 from the bottom side and from the top side as well, to heat the fibrous web 21. That is, the fibrous web 21 in the heating device is heated with being separated from a lower support member and from an upper support member as well. Note that hot air may blow onto the fibrous web 21 from the top and bottom sides alternately.

Specifically, while the irregularities are formed by heating on the free face side only in the above-described nonwoven fabric production method, in the present modified example, the irregularities are formed on both sides of the fibrous web 21, because the fibrous web 21 is heated without being supported by the support member at the bottom side of the fibrous web 21. Then, by pressing the fibrous web 21 on which irregularities are formed on both sides of the fibrous web 21, a situation can be avoided in which the fiber density is higher in the free face side than in the supported face side, and in the high density region, more regions having a high fiber density are formed on one side (free face side), as in the high density region 11 of the nonwoven fabric described above. In other words, the nonwoven fabric produced by the modified example includes a high density region where the fiber density is higher on one side in the thickness direction than in the other side, and a high density region where the fiber density is higher in the other side than in the one side. Therefore, in the high density region, regions where the fiber density is high are uniformly formed on both sides of the nonwoven fabric.

Index of Dispersion (Standard Deviation of Average Absorbance)

In the nonwoven fabric 10 produced by the nonwoven fabric production method of the present embodiment, the high density region 11 and the low density region 12 are formed dispersed in the planar direction. The degree of this dispersion can be indicated by, for example, an index of dispersion (standard deviation of average absorbance).

The "standard deviation of average absorbance" serving as the "index of dispersion", is a value that indicates the darkness irregularities (unevenness) in the nonwoven fabric when the nonwoven fabric 10 is illuminated from the bottom. The index of dispersion can be measured and calculated by using a certain meter (for example, formation tester (model type: FMT-MIII, manufactured by Nomura Shoji, Co., Ltd.)). Measurement conditions can be set for example, camera correction sensitivity: 100%, binarization threshold±%: 0.0, movement pixel: 1, effective size: 25×18 cm. The index of dispersion can be measured setting the face supported by the support member during manufacturing as a front face. In addition, other known measurement methods can be used to measure the index of dispersion.

The index of dispersion in the nonwoven fabric 10 of the present embodiment is from 250 to 450 inclusive, and preferably, from 280 to 410 inclusive.

When the index of dispersion is less than 250, the state of the high density region 11 and the low density region 12 is too close to be uniform, that is, the difference in the density between the high density region 11 and the low density region 12 is too small. Therefore, there is a risk that it is impossible to achieve effects expected to the respective regions (the low scattering properties in the low density region 12, and the fluid drawing properties and the low remaining properties in the high density region 11). On the contrary, when the index of dispersion is more than 450, the fiber density irregularity becomes too large, and for example, there is a possibility that the density in the high density region 11 is extremely high. In such a case, there is a possibility that fluid drawn inside the nonwoven fabric 10 remain in the high density region 11. Meanwhile, in the low density region, the volume of fiber becomes extremely small, and there is a possibility that a small amount of fluid remain in the low density region. Then, for example, in an absorbent article in which a nonwoven fabric whose index of dispersion is more than 450 is disposed between the surface sheet and the absorbent body, fluid drawn from the surface sheet remains in the high density region, and the fluid does not move to the absorbent body. When the fluid in the high density region overflows, the capillary force due to the difference in density ceases to work. When a large amount of fluid is excreted or fluid is repeatedly excreted, the fluid widely spreads in the second sheet or the surface sheet, and remains there.

Therefore, by setting the index of dispersion in the nonwoven fabric 10 of the present embodiment to the range from 250 to 450 inclusive, it is possible to exclude nonwoven fabrics in which the high density region 11 and the low density region 12 are not formed since fibers were not relocated during heating of the fibrous web, or nonwoven fabrics in which a region having an extremely high fiber density has been made. In other words, with the present embodiment, the nonwoven fabric 10 can be obtained, in which the high density region 11 and the low density region 12 have been formed dispersed in the planar direction, and the difference in density between the high density region 11 and the low density region 12 is appropriate, because fibers are appropriately relocated in the planar direction during heating of the fibrous web.

Absorbent Article

Outline of Absorbent Article

Figure 12A:
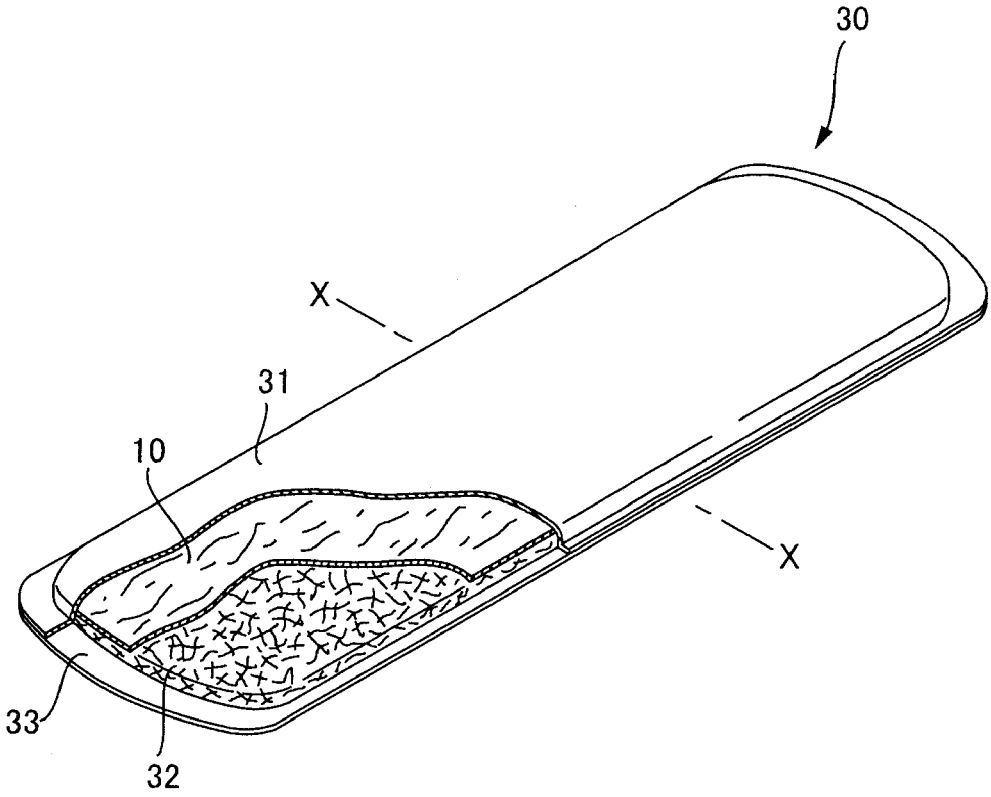
FIG. 12A is a perspective view of a sanitary napkin of the present embodiment.
Figure 12B:
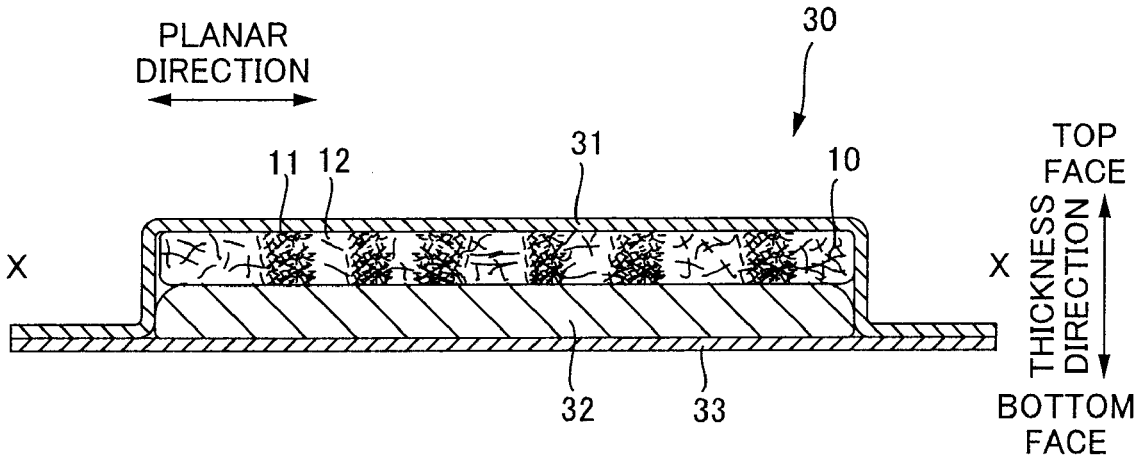
FIG. 12B is a cross-sectional view of an absorbent article of the present embodiment.

An absorbent article using the nonwoven fabric produced by the nonwoven fabric production method of the present embodiment will be described below. FIG. 12A is a perspective view of a sanitary napkin 30 as an example of the absorbent article, and FIG. 12B is a cross-sectional view of the sanitary napkin 30.

The absorbent article (sanitary napkin) 30 of the present embodiment includes a surface sheet 31, at least part of which is fluid-permeable, and a fluid-impermeable back face sheet 33, a fluid-retaining absorbent body 32 disposed between the surface sheet 31 and the back face sheet 33, and the second sheet 10 disposed between the surface sheet 31 and the absorbent body 32.

Also, the above-described nonwoven fabric 10 is used as the second sheet 10 of the absorbent article 30 of the present embodiment. Specifically, in the second sheet 10 of the absorbent article 30, the high density region 11 having a higher fiber density than an average fiber density of the second sheet 10 and the low density region 12 having a lower fiber density than the average fiber density are formed. The high density region 11 and the low density region 12 both penetrate from the surface sheet 31 side to the absorbent body 32 side. And the high density region 11 and the low density region 12 are formed so as to be dispersed in a planar direction of the second sheet 10.

Furthermore, in the high density region 11 of the above-described nonwoven fabric 10, the fiber density is higher in the other side than in the one side (FIG. 3). The nonwoven fabric 10 (second sheet) is disposed between the surface sheet 31 and the absorbent body 32 such that a side, of the high density region 11, having a higher fiber density (the other side, a face opposite to the net) faces the absorbent body 32 side. That is, in the high density region 11 of the second sheet 10 of the absorbent article, the capillary force is stronger in the absorbent body 32 side than in the surface sheet 31 side.

Sanitary Napkin

The absorbent article 30 of the present embodiment can be used for sanitary napkins, panty liners, diapers, incontinence pads, labial sanitary pads or the like. Below, the sanitary napkin 30 will be described as an example. The sanitary napkin 30 is worn such that the surface sheet 31 is placed on the human skin side, and the back face sheet 33 is placed on the undergarment side. As shown in FIG. 12B, in the second sheet 10 (nonwoven fabric), the high density region 11 and the low density region 12 that penetrate from the surface sheet 31 side to the absorbent body 32 side are formed so as to be dispersed in the planar direction of the second sheet 10. Also, the fiber density increases in the order of the surface sheet 31, the second sheet 10 and the absorbent body 32. Therefore, fluid on the surface sheet 31 moves to the second sheet 10 due to the capillary force, and the fluid further moves from the second sheet 10 to the absorbent body 32. The fluid is finally retained by the absorbent body 32.

FIGS. 13A to 13D are diagrams showing how fluid 40 excreted onto the surface sheet 31 is absorbed. Also, in the sanitary napkin 30 of the present embodiment, irregularities are formed on the top face side of the surface sheet 31.

Figure 13A:
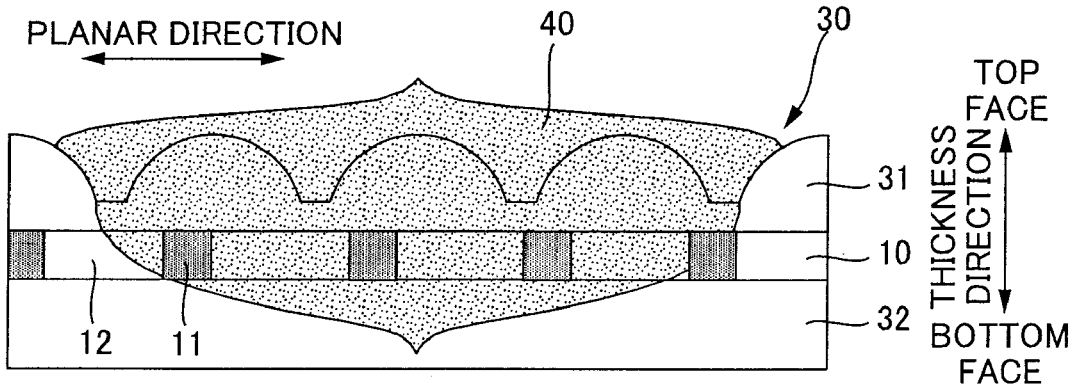
FIGS. 13A to 13D are diagrams showing how fluid excreted onto a surface sheet is absorbed.
Figure 13B:
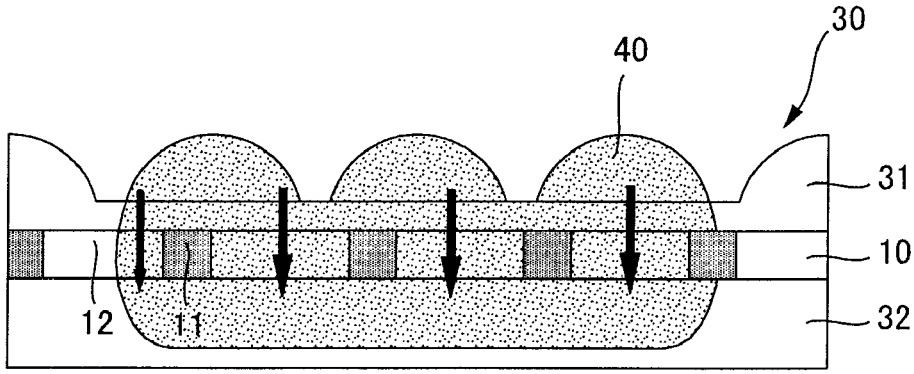

As shown in FIG. 13A, the fluid 40 such as menstrual blood is excreted onto the surface sheet 31 of the sanitary napkin 30. At this time, the fluid 40 in the surface sheet 31 remains in a concave section (groove section), and therefore the fluid 40 is suppressed from scattering in the planar direction. The fluid 40 moves to the second sheet 10 having a higher fiber density than the surface sheet 31. At this time, when a large amount of fluid of high flow velocity is excreted onto the surface sheet 31, a large portion of the fluid 40 first passes through the low density region 12 where resistance due to fibers is small, and moves to the absorbent body 32. Therefore, as shown in FIG. 13B, even when a large amount of fluid is excreted, the fluid 40 can quickly move to the absorbent body 32 since the low density region 12 penetrates in the thickness direction. Accordingly, it is possible to prevent the fluid 40 from scattering in the planar direction in the surface sheet 31 and the second sheet 10. That is, in the sanitary napkin 30 of the present embodiment, the fluid 40 is suppressed from scattering (having good spot absorbing properties). Also, an opening section may be formed in the concave section of the surface sheet 31. In this manner, fluid can move from the surface sheet 31 to the second sheet 10 in a more favorable manner.

Figure 13C:
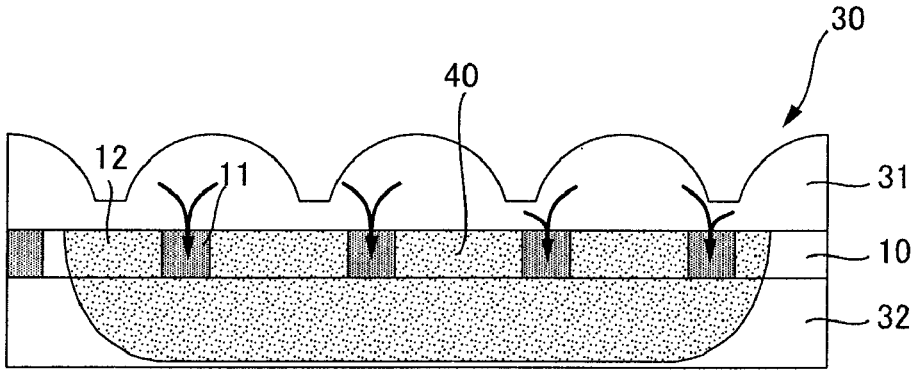
Figure 13D:
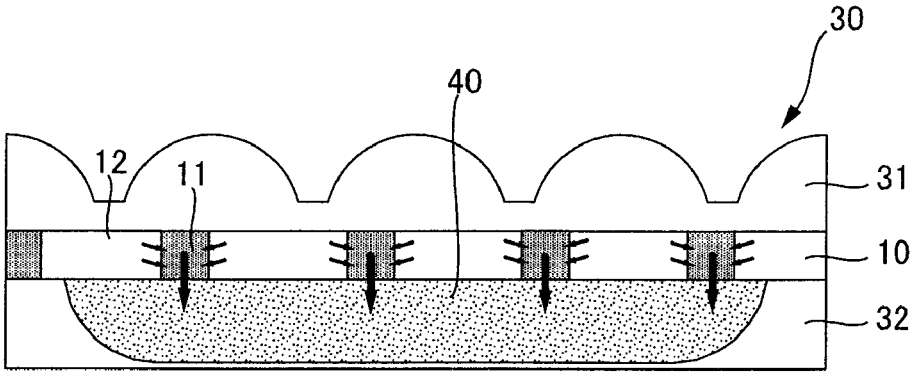

As shown in FIG. 13C, after a large portion of the fluid has moved to the absorbent body 32, the fluid 40 remaining in the surface sheet 31 can be drawn inside the second sheet 10 (high density region 11) due to the capillary force of the high density region 11 of the second sheet 10. Also, in the high density region 11, since the fiber density is higher in the absorbent body 32 side than in the surface sheet 31 side, the drawn fluid can be moved to the absorbent body 32 due to the capillary force. Note that the fiber density in the absorbent body 32 is assumed to be higher than the fiber density in a region having the highest fiber density in the high density region 11 in the second sheet 10 (region on the absorbent body 32 side). In this manner, fluid that has reached the lowermost face of the second sheet 10 (border section with the absorbent body 32) can move to the absorbent body 32 without remaining in the second sheet 10.

A large portion of the fluid 40 passes through the low density region 12 of the second sheet 10 and moves to the absorbent body 32 immediately after the fluid 40 has been excreted. However, when the amount of the fluid that moves from the surface sheet 31 decreases, the flow of the fluid from the surface sheet 31 becomes slow (the flow velocity decreases). As a result, there is a risk that the fluid 40 remains between fibers in the low density region 12. However, in the second sheet 10 (nonwoven fabric) of the sanitary napkin 30 of the present embodiment, the high density region 11 and the low density region 12 are formed adjacent to each other, and part of the fibers therein are tangled with each other. Therefore, a small amount of fluid 40 remaining in the low density region 12 can be drawn due to the capillary force of the high density region 11. The drawn fluid 40 then moves to the absorbent body 32 due to the capillary force of the high density region 11.

As a summary of the above description, in the absorbent article (sanitary napkin 30) of the present embodiment, fluid excreted onto the surface sheet 31 is suppressed from scattering in the planar direction due to the convex section of the surface sheet 31. Also, a large portion of the fluid coming from the surface sheet 31 quickly moves to the absorbent body 32 via the low density region that penetrates from the surface sheet 31 to the absorbent body 32. Therefore, it is possible to suppress the fluid from scattering in the planar direction.

After a large portion of the fluid has moved to the absorbent body 32, a small amount of fluid remaining in the surface sheet 31 or the low density region 12 is drawn to the high density region 11. The drawn fluid can move to the absorbent body 32 due to the difference in density inside the high density region 11, and the capillary force caused by the difference in density between the high density region 11 and the absorbent body 32. That is, the fluid 40 is absorbed in the absorbent body 32, without remaining in the surface sheet 31 or the second sheet 10.

That is, the absorbent article (sanitary napkin 30) of the present embodiment is an absorbent article that fluid permeates without being scattered, whose fluid drawing properties is good, and in which fluid hardly remains. Since the fluid reliably moves to the absorbent body 32, the surface sheet 31 and the second sheet 10 can be dried up to a predetermined state after the fluid is excreted. As a result, it is possible to prevent the skin of the wearer from being soiled by the fluid or making the user feel discomfort (giving wet and sticky sensation). In addition, even when the fluid is excreted repeatedly, the fluid does not overflow onto the surface sheet 31 (scatter in the planar direction), and is repeatedly absorbed by the absorbent body 32.

Also, even when a small amount of fluid is excreted, the fluid can be reliably moved to the absorbent body 32 via the high density region 11. Even in the case of fluid having a high viscosity, the fluid can be moved to the absorbent body 32 by causing the absorbent article to permeate through the low density region 12, where the resistance by fibers is low. Specifically, in the absorbent article (sanitary napkin 30) of the present embodiment, it is possible to absorb the fluid in the absorbent body 32 regardless of the viscosity or the amount of the fluid excreted onto the surface sheet 31.

While fiber used in the nonwoven fabric has already been described, it is preferable that the fiber itself has high opacifying properties, and in particular, has high whitening power. By employing fiber having opacifying properties, even when dark body fluid such as menstrual blood is absorbed, the color of the body fluid itself can be concealed. Therefore the impression of cleanness can be visually kept. Furthermore, when an opening is provided in the surface sheet 31, the menstrual blood spreading in the absorbent body can be seen more easily through the opening section. However, if the second sheet itself has high whitening power, such concealing properties can be achieved even for the opening section.

Specifically, the nonwoven fabric is made of fiber that contains a light beam transmission suppressor having a fine particle form and suppressing transmission of light. Inorganic filler can be used as a light beam transmission suppressor for opacifying, for example. Examples of this inorganic filler include, for example, titanium oxide, calcium carbonate, talc, clay, kaolin, silica, diatom earth, magnesium carbonate, barium carbonate, magnesium sulfate, barium sulfate, calcium sulfate, aluminum hydroxide, magnesium hydroxide, zinc oxide, calcium oxide, alumina, mica, powdered glass, Shirasu-balloon, zeolite, and silicate clay. Two or more of these may be contained in combination. Especially, from the viewpoint of processes in the fiber manufacturing stage, generally, titanium dioxide is preferable. The average particle diameter of the light beam transmission suppressor is preferably in a range of 0.1 μm or more and 2 μm or less, and more preferably, in a range of 0.2 μm or more and 1 μm or less. In order to obtain sufficient concealing properties (whiteness), the content of titanium dioxide as the light beam transmission suppressor in the fiber weight is preferably 1 wt % or more, and more preferably, 2 wt % or more.

When the fiber constituting the nonwoven fabric is sheath-core bicomponent fiber, the content of the light beam transmission suppressor in the core section is preferably 2 wt % or more and 10 wt % or less, for example. If the content is less than 2 wt %, it is difficult to obtain the concealing properties, and if the content is more than 10 wt %, the fiber itself will become too soft, and it is difficult to make the fiber bulky.

In the sanitary napkin 30, although a single sheet of the nonwoven fabric 10 described above is used as the second sheet, this is not a limitation. A plurality of second sheets (nonwoven fabric 10) may be disposed between the surface sheet and the absorbent body. In this case, the plurality of the second sheets (nonwoven fabric 10) are layered such that at least respective one of the high density regions 11 and the low density regions 12 penetrate from the surface sheet 31 side to the absorbent body 32 side. Also, for example, when a plurality of sheets of the nonwoven fabric 10 are layered for use, whose fiber densities of the low density region 12 and the high density region 11 differ from each of the sheets, the difference in density occurs in the thickness direction. Therefore, the fluid can be drawn to the lower side (absorbent body side) due to the capillary force.

Also, a configuration is adopted in which the nonwoven fabric 10 (second sheet) is disposed between the surface sheet 31 and the absorbent body 32 such that the side, of the high density region 11, that has the higher fiber density (free face, the face opposite to the net) faces the absorbent body 32 side. However, there is not a limitation to this. Since the high density region that does not penetrate in the thickness direction is also formed on the free face side of the nonwoven fabric 10 (FIG. 5D), it can be said that more high density regions are formed in the free face side, compared with the supported face side (net face). On the contrary, it can be said that more low density regions are formed in the supported face side compared with the free face side.

As described above, when a face of the second sheet (nonwoven fabric 10) on which more low density regions are formed (supported face side) is placed on the surface sheet 31 side, it is possible to quickly move the fluid in the surface sheet 31 to the absorbent body 32 side. On the contrary, when the face on which more low density regions are formed is placed on the absorbent body 32 side, the fluid contained in the surface sheet 31 can be drawn in a favorable manner and moved to the absorbent body 32 side. When a large number of regions where fibers (heat-shrinkable fiber) are densely gathered contact the surface sheet 31, the friction between the surface sheet 31 and the second sheet increases; so that there are cases where the amount of an adhesive agent used for joining can be reduced. Also, it becomes easier for the fibers in the surface sheet 31 and the second sheet to be tangled with each other; so that there are cases where the surface sheet 31 and the second sheet are less easily shifted from each other even when twist occurs in the absorbent article. In this manner, by adjusting the orientation in which the nonwoven fabric 10 is disposed, different functions can be exhibited using the same nonwoven fabric 10.

The nonwoven fabric 10 can be used as the second sheet in a folded up state. In this case, the nonwoven fabric 10 is assumed to be folded up such that at least one of high density regions 11 and at least one of low density regions 12 penetrate from the surface sheet 31 side to the absorbent body 32 side. In such a case, by folding the nonwoven fabric 10 while placing a face on which more high density regions 11 are formed inside, the faces on which more high density regions 11 are formed oppose each other, and a region can be formed in which the fluid that has moved from the surface sheet can be temporarily retained.

Constituent elements other than the nonwoven fabric (second sheet) of the absorbent article of the present embodiment will be described below in detail.

Surface Sheet

The fluid-permeable region of the surface sheet 31 is formed with a plastic film in which a large number of fluid-permeable openings are formed, a net-shaped sheet including a large number of meshes, a fluid-permeable nonwoven fabric, a woven fabric, or the like. Examples of material for the plastic film or the net-shaped sheet include polypropylene (PP), polyethylene (PE), polyethylene terephthalate (PET), or the like.

The diameter of the opening (diameter of the fluid-permeable opening) is preferably in a range of 0.05 mm or more and 3 mm or less, and the pitch is preferably in a range of 0.2 mm or more and 10 mm or less, and the area ratio of the opening is preferably 3% or more and 30% or less. A plurality of openings may be formed in an integrated manner with the low density region 12 of the second sheet 10. The openings can be arranged in a zigzag form, grid form, wave form or the like; their arrangement is not particularly limited. The shape of the opening may be a circle, an oval, a quadrangle, or the like. A valve may be provided in the rim of the opening. Alternatively, when a large number of the fluid-permeable openings are formed, silicone or fluorine water-repellent oil agent may be applied, such that body fluid hardly attaches the outer face of the surface sheet.

When the fluid-permeable region of the surface sheet 31 is a nonwoven fabric, a spunlace nonwoven fabric formed by cellulose fiber such as rayon or plastic fiber, an air-through nonwoven fabric formed by the plastic fiber, or the like may be used.

Other than those listed above, biodegradable natural products such as polylactic acid, chitosan, polyalginic acid, or the like can be used.

The weight of the surface sheet is preferably 15 g/m$^2$ or more and 100 g/m$^2$ or less, more preferably 20 g/m$^2$ or more and 50 g/m$^2$ or less, and especially preferably 30 g/m$^2$ or more and 40 g/m$^2$ or less. If the weight is less than 15 g/m$^2$, sufficient surface strength is not secured. There is a risk that the surface sheet is torn when in use. If the weight is more than 100 g/m$^2$, the surface sheet feels excessively rough, and gives the wearer an unpleasant sensation when in use. Furthermore, if the weight is more than 40 g/m$^2$, in the case of long hours of use, the fluid is retained in the surface sheet 31, which keeps the surface sheet 31 wet and sticky, and the user feels discomfort. As regards the density, there is no limitation as long as the density of the surface sheet is 0.12 g/cm$^3$ or less and the surface sheet is fluid-permeable. If the density exceeds 0.12 g/cm$^3$, it is hard for the fluid to permeate through fibers in the surface sheet smoothly. In the case of menstrual blood, the density is preferably set low since menstrual blood has a comparatively higher viscosity than urine.

Back Face Sheet

The back face sheet 33 is a fluid-impermeable sheet, in which materials that can prevent excreted materials absorbed in the absorbent body 32 from leaking outside are used. By using a moisture-permeable material, a stuffy sensation during wearing can be mitigated, thereby reducing sense of discomfort during wearing.

Examples of such a material include a fluid-impermeable film which is mainly composed of polyethylene (PE), polypropylene (PP) or the like, a breathable film, and a composite sheet formed by laminating a fluid-impermeable film on one side of a nonwoven fabric such as a spunbonded nonwoven fabric. Preferably, a hydrophobic nonwoven fabric, a water-impermeable plastic film, a laminated sheet of a nonwoven fabric and a water-impermeable plastic film, or the like may be used. Also, an SMS nonwoven fabric is also acceptable in which a meltblown nonwoven fabric having good water-resistance is sandwiched between spunbonded nonwoven fabrics having high rigidity.

Absorbent Body

Since the absorbent body 32 has a function to absorb and retain fluid such as menstrual blood, the absorbent body 32 is preferably bulky, is good in keeping the shape thereof, and preferably does not cause a significant chemical stimulation. For example, an absorbent body material made up of superabsorbent polymer and fluff pulp or an air-laid nonwoven fabric can be given as an example.

Instead of fluff pulp, artificial cellulose fibers such as chemical pulp, cellulose fiber, rayon, and acetate can be given as an example for example. For example, an absorbent body may be formed by wrapping with tissue having a weight of 15 g/m$^2$, a mixture in which pulp having a weight of 500 g/m$^2$ and polymer having a weight of 20 g/m$^2$ (polymer being dispersed in whole) are dispersed uniformly in whole.

As an example of the air-laid nonwoven fabric, a nonwoven fabric formed by affixing with a binder or heat-welding pulp and synthetic fiber can be raised. Examples of the superabsorbent polymer (SAP) include, for example, starch polymer, acrylic-acid polymer, and amino-acid polymer that are particulate or fibrous. The shape and structure of the absorbent body 32 can be changed as necessary. The total absorption volume of the absorbent body 32 is required to comply with the designed insertion amount as an absorbent article and the desired application. The size, absorbing ability, and the like of the absorbent body 32 are changed in accordance with applications.

Evaluation of Nonwoven Fabric

Evaluation Method of Absorption Properties Using Artificial Menstrual Blood

In order to evaluate absorption properties of samples, the fluid remaining properties, the scattering properties and the re-wet properties can be evaluated using artificial menstrual blood.

The composition of the artificial menstrual blood used here is as follows.

The followings are mixed into one liter of ion-exchanged water. (1) glycerin, 80 g, (2) sodium carboxymethylcellulose (NaCMC), 8 g, (3) sodium chloride (NaCl), 10 g, (4) sodium hydrogen carbonate (NaHCO3), 4 g, (5) Pigment: Red No. 102, 8 g, (6) Pigment: Red No. 2, 2 g, and (7) Pigment: Yellow No. 5, 2 g.

Measurement tools used include, for example, 1) auto-burette (Metrohm, Model No. 725), 2) SKICON, 3) colorimeter, 4) perforated acrylic board (including an opening of 40 mm×10 mm in the center, length×width=200 mm×100 mm, weight: 130 g), 5) scale, 6) ruler, 7) artificial menstrual blood, 8) stopwatch, and 9) filter paper.

Evaluation samples are prepared in the manner described below. The surface sheet is cut into a size (arbitrary) of length×width=100 mm×60 mm, and the weight and thickness thereof are measured. The nonwoven fabric as a measurement sample is cut into a size (arbitrary) of length×width=100 mm×60 mm, and the weight and thickness thereof are measured. As an absorbent body, an NB pulp absorbent body is wrapped with tissue paper of 15 gsm, which is cut into a size of 100 mm×60 mm. Then, the surface sheet, the nonwoven fabric and the absorbent body are joined by embossing. The embossing is hinge embossing (narrowest width: 38 mm).

Evaluation procedure is as follows. 1) The acrylic board is placed on a sample such that the center of the opening of the acrylic board is matched to the center of the sample. 2) A nozzle of the auto-burette is positioned 10 mm above the acrylic board. 3) The first drip of artificial menstrual blood is performed under the following conditions (rate: 95 ml/min, drip amount: 3 ml). 4) A stopwatch is started upon commencement of dripping, the stopwatch is stopped when almost all of the artificial menstrual blood has disappeared from the surface (when the artificial menstrual blood has ceased to flow), and the speed of absorption is measured (A). 5) Another stopwatch is started concurrently with stopping the stopwatch, and when the artificial menstrual blood inside the surface sheet has disappeared (when the artificial menstrual blood has ceased to flow), that other stopwatch is stopped, and the complete drying rate is measured (B). 6) Remove the acrylic board. 7) Upon passage of one minute after commencement of dripping, the scattering range and SKICON value (surface drying properties), and the colorimeter (whiteness) are measured (C, D and E). 8) Second dripping of the artificial menstrual blood is performed (rate: 95 ml/min, drip amount: 4 ml). 9) A stopwatch is started upon commencement of dripping, the stopwatch is stopped when almost all of the artificial menstrual blood has disappeared from the surface (when the artificial menstrual blood has ceased to flow), and the speed of absorption is measured (F). 10) Another stopwatch is started concurrently with stopping the stopwatch, and when the artificial menstrual blood inside the surface sheet has disappeared (when the artificial menstrual blood has ceased to flow), that other stopwatch is stopped, and the complete drying rate is measured (G). 11) Remove the acrylic board. 12) Upon passage of one minute after commencement of dripping, the scattering range and SKICON value (surface drying properties), and the colorimeter (whiteness) are measured (H, I and J). 13) The filter paper and the acrylic board are placed on the sample, and a weight of 50 g/cm$^2$ is put thereon and left for 1.5 minutes. 14) After 1.5 minutes, the weight of the filter paper is measured to measure the first re-wet rate (K). 15) The filter paper and the acrylic board are placed on the sample, and further a weight of 100 g/cm$^2$ is put thereon and left for 1.5 minutes. 16) After 1.5 minutes, the weight of the filter paper is measured to measure the second re-wet rate (L).

Based on the measurement results of the above A to L, the following evaluation results can be obtained.

1) First time (3 ml dripping): speed of absorption (sec) (A), complete drying rate (sec) (B), scattering range (MD×CD (mm)) (C), SKICON value (ps) (D), whiteness (E) (–) (E)

2) Second time: (4 ml dripping (7 ml in total)): speed of absorption (sec) (F), complete drying rate (sec) (G), scattering range (MD×CD) (mm) (H), SKICON value (μs) (I), whiteness (E) (–) (J)

3) (1) First re-wet rate (with a weight of 50 g/cm$^2$) (K), (2) Second re-wet rate (with a weight of 100 g/cm$^2$) (L)

Evaluation Method of Absorption Properties Using Artificial Urine

In order to evaluate absorption properties of samples, the speed of absorption, the surface drying rate, the scattering state and the re-wet properties can be evaluated using artificial urine.

Measurement tools used include, for example, (1) artificial urine, (2) burette and funnel (burette is adjusted such that the dripping rate is 80 ml/10 sec), (3) burette stand, (4) cylinder (60 mm of diameter, 550 g), (5) filter paper (for example, Advantech, No. 2 (100 mm×100 mm)), (6) weight of 3.5 kg/100 cm$^2$, (7) stopwatch, (8) electronic balance, (9) ruler, and (10) scissors.

The above artificial urine is prepared by mixing, into 10 liters of ion-exchanged water (I), urea (200 g) (II), sodium chloride (salt) (III), magnesium sulfate (8 g) (IV), calcium chloride (3 g) (V), and Pigment: Blue No. 1 (approximately 1 g). The sample for evaluation is prepared by removing the nonwoven fabric of a commercially-available disposable diaper (Product Name: MuNi (L size) of Unicharm Corporation), and using the resultant with a predetermined top sheet and a nonwoven fabric as a second sheet (disposed such that, for example, the free face side where more high density regions are formed faces the top sheet).

The evaluation procedure is as follows. For example, evaluation can be performed by repeating the following evaluation procedure three times, taking 10 minutes as one cycle. (1) Mark the re-wet dripping position with a felt pen. (2) Measure the weight of the sample and the thickness at the re-wet dripping position (check whether the sample weight is correct). (3) Fix the burette 10 mm above the dripping position. (4) Put the burette in the dripping position (center of the cylinder) and drip artificial urine, and at the same time, start measuring the speed of absorption with a stopwatch. (5) Stop the stopwatch once when the artificial urine in the cylinder has been absorbed completely, and disappeared from the surface. (6) Stop the stopwatch once when the fluid remaining in the top sheet has completely moved to the second sheet. (7) Measure the weight (A) of the filter paper of approximately 50 g, and fill in the form. (8) Upon passage of five minutes after commencement of dripping, the filter paper of (7), whose weight has been already measured, is placed on the sample while the central position of the filter paper being matched to the dripping position, and the weight is placed thereon. (9) Upon passage of eight minutes after commencement of dripping (three minutes after placing the weight), remove the weight and measure the weight (B) of the filter paper, and fill in the form. (10) If the second or third measurement remains, the next measurement is commenced upon passage of ten minutes after commencement of dripping. (11) Repeat the measurement three times. (12) When the measurement is finished for the number of the measurement times, the scattering length is measured for each time.

The scattering length is measured with the ruler at the portion where the artificial urine has scattered over the longest area in the longitudinal direction on the skin-side surface of the absorbent body, the ruler being placed parallel to the absorbent body. The re-wet amount is measured by the following formula; "The weight of paper filter after re-wet (B)—The weight of paper filter (A)".

Evaluation of Nonwoven Fabric of the Present Embodiment

The nonwoven fabric was actually produced and the index of dispersion, the absorption properties and the like thereof were evaluated. The production conditions, evaluation results and the like of the nonwoven fabric will be described below. FIG. 14 is a table describing the structure of the nonwoven fabrics of the Examples and the measurement results of average absorbance of the nonwoven fabrics of the Examples. FIG. 15 is a table describing the measurement results of average absorbance when the nonwoven fabric of the Example D is layered. FIG. 16 is a table describing evaluation results of the absorption properties of the nonwoven fabrics of the Examples using the artificial urine. FIG. 17 is a table describing the evaluation results of the absorption properties of the nonwoven fabrics of the Examples using the artificial menstrual blood. FIG. 18 is a table describing the measurement results of the average empty space area between fibers in the Example D.

The nonwoven fabric of the invention was produced under the following conditions.

(1) Fiber Structure

According to the fiber structure described in the table in FIG. 14, the nonwoven fabrics of the Examples A to E, and the nonwoven fabrics of the Comparative Examples A and B were produced.

(2) Production Method (a) The fiber structure shown in the table in FIG. 14 is spread using a carding machine at 20 m/min, thereby creating a fibrous web. Then, the fibrous web is cut so as to have a width of 450 mm.

(b) The fibrous web that is cut into MD 300 mm×CD 300 mm is placed on the breathable net of 20 meshes, and transported at a speed of 3 m/min. The fibrous web is transported through a heating apparatus (oven) of 1.5 m long, while being heated at 145° C. (418.15K) and at a wind speed of 0.7 m/s, over approximately 30 seconds.

(c) Irregularities on the face opposite to the net are pressed.

(3) Measurement of Coexistence Ratio (Dispersion Degree) of High Density Region and Low Density Region As shown in the table in FIG. 14, the index of dispersion of each type of the nonwoven fabrics was measured. The measurement results of the index of dispersion are also shown in the table in FIG. 14.

The index of dispersion for the Examples A to E fell within a range from 287 to 396. The results fell within the above-described range of index of dispersion, from 250 to 450 inclusive. The Comparative Example A is made up of thermal welding fiber only, and is an ultra-low density sheet in which the density in the planar direction thereof is substantially uniform. The index of dispersion in this Comparative Example A was 204. The Comparative Example B is also made up of thermal welding fiber only, and is an ultra-high density sheet in which the density in the planar direction thereof is substantially uniform. The index of dispersion in this Comparative Example B was 206.

Also, as shown in the table in FIG. 15, the index of dispersion of the nonwoven fabric formed by layering the nonwoven fabric of the Example D was measured. According to the measurement results in the table in FIG. 15, the indices of dispersion in the Example D, the Example D2 formed by layering two sheets of the nonwoven fabric of the Example D, and the Example D3 formed by layering three sheets of the nonwoven fabric of the Example D were not significantly different, each having values in a similar range. Accordingly, the nonwoven fabric formed by layering plural sheets of the nonwoven fabric of the invention is expected to have similar absorption properties as a single sheet of the nonwoven fabric.

(4) Evaluation of Absorption Properties

A. Evaluation of Absorption Properties Using Artificial Urine

In accordance with the above-described evaluation method, the absorption properties were evaluated for the Examples A and E and the Comparative Examples A and B using the artificial urine. Based on the evaluation results shown in the table in FIG. 16, the absorbent articles in which the Examples A and E are used as the second sheet exhibit good speed of absorption, and the fluid movement from the surface sheet to the absorbent body (fluid drainage rate) is fast. In contrast, although the Comparative Example A exhibits good speed of absorption, the fluid movement from the surface sheet to the absorbent body is slow. Also, although in the Comparative Example B the fluid movement from the surface sheet to the absorbent body is fast, the speed of absorption is slow.

Based on the above facts, the absorbent articles in which the nonwoven fabrics of the Examples A and E are used as the second sheet exhibit good speed of absorption, and the fluid movement from the surface sheet to the absorbent body is fast. That is, the nonwoven fabrics of the Examples A and E have low scattering properties when the fluid permeates the nonwoven fabric, and do not impair fluid movement from the surface sheet to the absorbent body.

B. Evaluation of Absorption Properties Using Artificial Menstrual Blood

In accordance with the above-described evaluation method, the absorption properties were evaluated for the Examples D1 and D2 and the Comparative Examples A and B using the artificial menstrual blood. That is, the absorption properties were evaluated for the absorbent articles in which the Examples D1 and D2 and the Comparative Examples A and B are used as the second sheet. Here, the Example D1 is a nonwoven fabric formed by folding the Example D while placing the free face thereof (the face opposite to the net, where more high density regions are formed) inside. The Example D2 is a nonwoven fabric formed by folding the Example D while placing the free face thereof (the face opposite to the net, where more high density regions are formed) outside. The following surface sheet was used as the surface sheet used in the samples for absorption evaluation.

Fiber Structure of Surface Sheet

In the surface sheet, for the upper layer, fiber A, which has the sheath-core structure of high-density polyethylene and polyethylene terephthalate, having an average fineness of 3.3 dtex and an average fiber length of 51 mm, and is coated by a hydrophilic oil agent, is used. For the lower layer, fiber formed by blending the following fibers at the ratio of 50:50 is used: fiber B, which has the sheath-core structure of high-density polyethylene and polypropylene, having an average fineness of 3.3 dtex and an average fiber length of 51 mm, and is coated by a hydrophilic oil agent, and fiber C, which has the sheath-core structure of high-density polyethylene and polyethylene terephthalate, having an average fineness of 2.2 dtex and an average fiber length of 51 mm, and is coated by a hydrophilic oil agent. The ratio between the upper and lower layers is 16:9, and the total weight is 30 gsm.

Production Method of Surface Sheet

A fibrous web is created through spreading using a carding machine at 20 m/min, and the fibrous web is cut so as to have a width of 450 mm. The fibrous web is placed on a sleeve and transported onto the breathable net of 20 meshes transported at a speed of 3 m/min (the upper layer side opposes the mesh). After that, the fibrous web is transported through an oven set to a temperature of 125° C. and a hot air volume of 10 Hz, over approximately 30 seconds, while being transported by the breathable net.

Preparation of Evaluation Samples

Samples for the absorption evaluation were prepared by cutting each of the above surface sheets, Examples D1 and D2, and Comparative Examples A and B, into a size of 100 mm in length and 70 mm in width. Then, the absorption core is formed by sandwiching with tissue of 16 g/m$^2$ fluff pulp of 500 g/m$^2$ adjusted so as to have a thickness of 5 mm. Then the absorption core, the surface sheet and each of the above nonwoven fabrics as the second sheet are layered and joined by hinge-embossing set such that the portion narrowest in width of the sample is 38 mm, thereby preparing evaluation samples.

Measurement Method and Measurement Results

In accordance with the procedure described in the above-stated evaluation method, the absorption properties were evaluated for each of the samples prepared above. The measurement results are as shown in the table in FIG. 17. As shown in the table in FIG. 17, the samples for absorption evaluation in which the nonwoven fabrics of the Examples D1 and D2 were used as the second sheet generally showed a shorter permeation time, shorter complete drying time, and less surface scattering area, compared to the samples for absorption evaluation in which the nonwoven fabrics of the Comparative Examples A and B were used as the second sheet.

In particular, the absorbent article samples in which the nonwoven fabrics of the Examples D1 and D2 were used as the second sheet, showed a significantly shorter complete drying time and a significantly narrower surface scattering area, compared to the samples for absorption evaluation in which the nonwoven fabrics of the Comparative Examples A and B were used as the second sheet. Based on these results, the samples for absorption evaluation in which the nonwoven fabrics of the Examples were used as the second sheet have low scattering properties when the fluid permeates the nonwoven fabric, and do not prevent fluid movement from the surface sheet to the absorbent body.

Also, the samples have excellent surface drying properties and in addition, have repetitive drying properties. Furthermore, as shown in the table, the samples for absorption evaluation in which the nonwoven fabrics of the Examples D1 and D2 were used as the second sheet showed a low re-wet rate, compared with the samples for absorption evaluation in which the nonwoven fabrics of the Comparative Examples A and B were used as the second sheet. Therefore, the absorbent article in which the nonwoven fabric of the invention was used as the second sheet can achieve a low re-wet rate. In such an absorbent article, the fluid from the surface sheet moves to the absorbent body side in a favorable manner.

Although the uniform low-density nonwoven fabric such as the Comparative Example A exhibits good speed of absorption, the drying rate after fluid has entered the surface sheet is poor. In addition, capillary action does not readily occur due to low density, and fluid easily remains on the surface sheet. Therefore, the drying properties of the surface sheet are poor. Also, the uniform high-density nonwoven fabric such as the Comparative Example B exhibits poor speed of absorption, and it is difficult for fluid to enter the surface sheet. By using the nonwoven fabrics of the Examples, the speed of absorption in the low density region and the fluid drawing properties in the high density region allows the fluid movement not to be prevented from the surface sheet to the absorbent body.

(5) Evaluation of Fiber Density (Average Empty Space Area Between Fibers)

The average empty space area between fibers in the high density region and the low density region of the Example D was measured. 1) Sample product (Example D) is placed on the observation table with a product face to be observed facing upward. 2) A predetermined meter (for example, digital microscope, model No. VHX-100, Keyence Corporation) is used to capture the fiber face and the binarized image of fiber is obtained. 3) A value obtained by dividing the empty space area in the binarized image (area of a region where no fiber is present: μm$^2$) by the number of spaces present in the binarized image is the average empty space area between fibers (=empty space area/the number of spaces).

As shown in the table in FIG. 18, the average empty space area in the high density region of the Example D is smaller than the average empty space area in the low density region. In addition, the respective values of the average empty space area fall within the preferable range described above. Also, the difference in average empty space area between the high density region and the low density region falls within the preferable range described above. The average empty space area is larger in the supported face side (the one side) than in the free face side (the other side), and it is understood that the fiber density is higher in the free face side (the other side) than in the supported face side (the one side).

That is, the Example D produced in accordance with the above-described production method and fiber structure is a nonwoven fabric including the high density region and the low density region, in which the high density region and the low density region penetrate from the one side to the other side, and the fiber density is higher in the other side than in the one side in the high density region. Therefore, as understood from the evaluation test described above, the Example D is a nonwoven fabric that has the properties of both of the high density region and the low density region.

The above embodiments are for the purpose of elucidating the understanding of the invention, and are not construed as limiting the invention in any way. The invention can be modified or improved without departing from the gist thereof, and any equivalents thereof are of course included in the scope of the invention.

The invention claimed is:

1. A nonwoven fabric that has opposite first and second sides, a thickness direction between the first and second sides, and a planar direction perpendicular to the thickness direction, the nonwoven fabric comprising:

a high density region having a higher fiber density than an average fiber density of the nonwoven fabric and penetrating from the first side to the second side in the thickness direction, wherein the fiber density of the high density region in the first side is higher than that in the second side.

2. A nonwoven fabric according to claim 1, further comprising a low density region that penetrates from the first side to the second side in the thickness direction and that has a lower fiber density than the average fiber density, wherein a plurality of the high density regions and a plurality of the low density regions are dispersed in the planar direction.

3. A nonwoven fabric according to claim 2, wherein an index of dispersion that indicates a degree to which the high density regions and the low density regions in the nonwoven fabric disperse is from 250 to 450 inclusive.

4. A nonwoven fabric according to claim 1, wherein both sides of the nonwoven fabric are planer.

5. A method of producing a nonwoven fabric, said method comprising:

heating, without pressing, a fibrous web that has a thickness direction and contains a heat-shrinkable fiber having thermal welding properties at a temperature at which the heat-shrinkable fiber melts and undergoes thermal shrinkage, to define the fibrous web that includes, on a side thereof, a convex section and a concave section, wherein fibers are more densely gathered in a region corresponding to the convex section than in a region corresponding to the concave section; and pressing the fibrous web in the thickness direction such that the convex section that has been formed on the surface of the fibrous web in the heating is crushed, wherein the pressing is performed after the heating.

6. A method according to claim 5, wherein in the heating, the fibrous web is heated while being supported by a support member on an opposite side of the fibrous web in the thickness direction.

7. A method according to claim 6, further comprising a press member arranged above the fibrous web, wherein the press member has a first section disposed at a predetermined angle to a machine direction in which the fibrous web is transported.

8. A method according to claim 7, wherein the first section does not directly contact the fibrous web, and the press member further comprises a second section that directly contacts the fibrous web.

9. A method according to claim 7, wherein the heating comprises blowing hot air passing through the press member and at the temperature to the fibrous web.

10. A method according to claim 5, wherein in the pressing, the fibrous web is pressed such that a thickness of the fibrous web after the pressing is equal to or smaller than a thickness of the concave section before the pressing.

11. A method according to claim 5, wherein the heating comprises blowing hot air at the temperature to the fibrous web from both sides thereof in the thickness direction.

12. A method according to claim 5, further comprising transporting the fibrous web in a machine direction, wherein in the pressing, the fibrous web is arranged in the thickness direction between (i) a first roll and a second roll, and (ii) a press roll, and the press roll is arranged between the first roll and the second roll in the machine direction.

13. A method according to claim 12, wherein the press roll is arranged at one side of the fibrous web, and the first and second rolls are arranged at the other side of the fibrous web, said other side being opposite to said one side in the thickness direction perpendicular to the machine direction.

14. A method according to claim 13, wherein the first roll is arranged higher than the second roll in the thickness direction.

15. A method according to claim 5, further comprising transporting the fibrous web in a machine direction, wherein in the heating, the fibrous web is heated by a heating device, and in the pressing, the fibrous web is pressed by a press roll arranged in a vicinity of an exit of the heating device in the machine direction.

16. An absorbent article that has a thickness direction and a planar direction perpendicular to the thickness direction and that is adapted to contact with a human body, the absorbent article comprising:

a top face sheet, at least part of which is fluid-permeable;

a fluid-impermeable back face sheet;

a fluid-retaining absorbent body disposed between the top face sheet and the back face sheet; and a nonwoven fabric disposed between the top face sheet and the absorbent body in the thickness direction, wherein the nonwoven fabric includes a high density region that has a higher fiber density than an average fiber density of the nonwoven fabric, the high density region penetrating from a first side of the nonwoven fabric close to the absorbent body to a second side of the nonwoven fabric close to the top face sheet of the nonwoven fabric in the thickness direction, the fiber density of the high density region in the first side is higher than that in the second side.

* * * * *